US005983478A

United States Patent [19]

Dolan et al.

[11] Patent Number: 5,983,478

[45] Date of Patent: Nov. 16, 1999

[54] TUBE FORMING ON AN END FITTING

[75] Inventors: Larry E. Dolan, Renton; John L. Eickelberg, Seattle, both of Wash.; Blake E. Reed, Warner Robins; Ron N. Scarborough, Macon, both of Ga.

[73] Assignee: The Boeing Company

[21] Appl. No.: 09/043,284

[22] PCT Filed: Sep. 18, 1996

[86] PCT No.: PCT/US96/14970

§ 371 Date: Mar. 19, 1998

§ 102(e) Date: Mar. 19, 1998

[87] PCT Pub. No.: WO97/10907

PCT Pub. Date: Mar. 27, 1997

[51] Int. Cl.[6] ..... B21D 26/14; B21D 39/04; B23P 11/00; B23P 17/00

[52] U.S. Cl. ..... 29/419.2; 29/511; 29/516; 72/56

[58] Field of Search ..... 29/419.2, 511, 29/516, 243.5, 243.517, 283.5; 72/54, 56, 707; 403/274, 359, 375; 285/382

[56] References Cited

U.S. PATENT DOCUMENTS 3,132,290 5/1964 Kumpf .
3,360,972 1/1968 Schwinghamer et al. .
4,148,091 4/1979 Hansen et al. .
4,561,799 12/1985 Arena .

*Primary Examiner*—David P. Bryant
*Attorney, Agent, or Firm*—J. Michael Neary

[57] ABSTRACT

A process and apparatus for electromagnetically forming the end of an electrically conductive 2024 aluminum tube onto an end fitting includes energizing a main coil around a field concentrator movable into an opening in the main coil. The field concentrator has a wide circumferential flange that narrows down to an inner radial web having an axial channel through the center. The field concentrator is split horizontally into two halves, so the top half can be removed for insertion of the tube end and the end fitting. The end fitting has a tubular body that fits snugly into the end of the tube. A pair of carriages mounted on rails clamp the tube, and a gripper holds the end fitting in the proper position in the tube end. The carriages carry the field concentrator, and the tube with its end fitting positioned in the center of the field concentrator web, into the coil where a magnetic field generated by the coil and concentrated by the field concentrator forms the end of the tube onto the end fitting. Two axial edges of the forming magnetic field are positioned over or slightly inward from two cylindrical portions of the end fitting when the tube is formed onto the end fitting.

28 Claims, 33 Drawing Sheets

Fig. 36
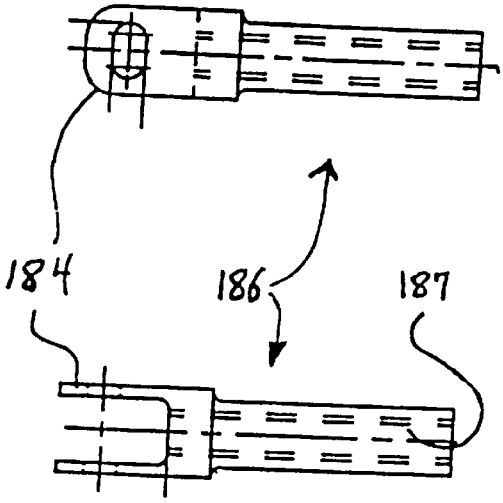
Fig. 35
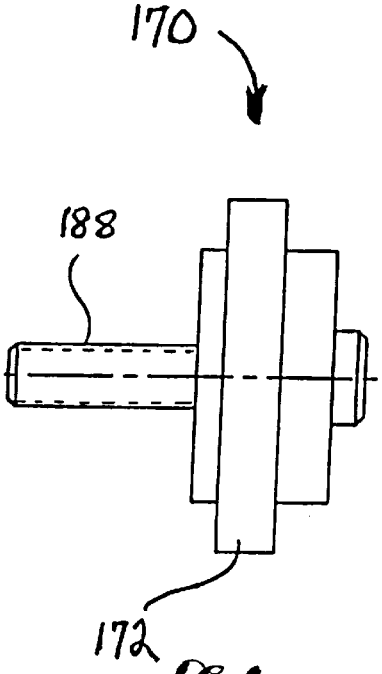
Fig. 37

TUBE FORMING ON AN END FITTING

This invention relates to end fittings for torque tubes that are mechanically connected at the ends of the tubes to the end fittings by forming the material of the tube ends around the end fittings, and to an apparatus for forming a portion of a tube onto an insert. More particularly, this invention relates to an end fitting onto which the ends of the torque tubes may be electromagnetically formed using tubing material as purchased without preliminary heat treating and storage at cold temperatures and to a tube forming apparatus for electromagnetically deforming the end of a tube onto an insert to form a torque transmitting mechanical joint between the tube and the insert that is as strong or stronger than the tube itself and is very fatigue resistant.

BACKGROUND OF THE INVENTION

There are many uses of an elongated metal tube having end fittings connected to the tube with a rigid mechanical joint. Push rods and torque tubes are two very common uses of this type of device. Torque tubes are used for mechanically transmitting torque from a driver to a driven device through a torque tube. These applications often require that the torque tube be light and inexpensive, have high fatigue strength and an ultimate yield strength at the end fitting equal to or exceeding that of the tube itself. Drive shafts for vehicles such as cars and trucks are examples of a type of torque tube requiring such characteristics. Presently, vehicle drive shafts are made of steel tubing attached at their ends to torque coupling fittings such as U-joint components or the like. The use of aluminum tubing in a vehicle drive shaft would have an attractive weight saving benefit, but the difficulties of forming high strength aluminum tubing onto the end fittings without expensive preliminary heat treating has deterred the use of aluminum tubing in this application.

In aviation applications, the requirements for light weight mechanical systems have dictated use of aluminum tubing for torque tubes for many years. However, the apparatus and methods for attachment of the end fittings on these torque tubes have some unsatisfactory properties that manufacturers and operators of commercial transport airplanes would prefer to eliminate. Riveting the end fitting onto the tube is costly because it is labor intensive. The rivets can loosen after extensive service, resulting in lost motion and possibly resulting eventually in failure after many years unless the torque tube is inspected and repaired or replaced when the rivets begin to loosen.

Welding or brazing the tubing to the end fitting presents the difficulties of a heat affected zone adjacent the fused joint, and low tolerance fit-up requirements for the fitting and the tube. Crack propagation in the fused joint can also be a problem; it may be difficult to detect by ordinary inspection procedures, and failures that do occur may be catastrophic and result in failure of flight critical control surfaces. Therefore, welding or brazing is rarely used in load-bearing flight critical hardware.

Mechanically forming the tubing onto the end fitting is a promising technique because it does not require fasteners nor produce the heat affected zone of a fused joint. Some potentially usable techniques for exerting pressure on the aluminum tubing to deform it around the end fitting for this purpose are swaging, hydroforming, rubber press forming, electromagnetically forming, explosive forming. Electromagnetic forming is especially appealing because of the potential for efficient, high volume, precisely repeatable production processes, but existing apparatus and techniques to deform aluminum tubing materials possessing the required properties of high strength and corrosion cracking resistance have resulted in formation of cracks in the tubing during forming onto the end fitting. The resulting cracks are unacceptable because of the shortening of the fatigue life of the torque tube.

Electromagnetically pulse forming 2024 aluminum tubing in the T-3 condition onto end fittings shown in U.S. Pat. No. 4,523,872 using an "exploding coil" for electromagnetically forming the 2024 aluminum was time consuming, because a new coil was needed for each forming operation. The exploding coil literally burst like a hand grenade, creating a shower of copper wire fragments that required careful shielding to prevent injury to the workers, and to protect them from the loud noise involved in the operation.

The production equipment used to form the tubing around the end fittings must be durable, repeatable and accurate. That is, it must be capable of producing many parts without wear or need for adjustment. The parts it produces must always be the same for a given setting of the equipment, and the equipment must be capable of easily, quickly and accurately indexing the parts to be formed in exactly the same place so they are positioned accurately with respect to each other and with respect to the equipment each time a torque tube is made. Likewise, the components of the equipment must be accurately positioned relative to each other the same way each time the tube is formed on an end fitting so that substantially identical torque tubes are made using identical settings of the equipment and acting on identical parts.

Thus, there has been an urgent need for an apparatus for electromagnetic pulse forming an end fitting on an aluminum tube for manufacture of torque tubes, push rods and other such devices. The apparatus should form acceptable joints even if the tubing material were primed with corrosion protection coatings before forming, and should be useful to form the end of the tube onto the end fitting without further preparation such as sizing, heat treating or freezer storage. The process for such an optimal system would produce very little or no scrap or rework, would be low in production cost, and would produce a torque coupling to the tube material that would be stronger than the tube itself and, when used to make torque tubes for aviation applications, would withstand fatigue loading for a period exceeding about four times the service life of an airplane.

SUMMARY OF THE INVENTION

Accordingly, it is an object of this invention to provide an improved process of forming a conductive metal tube onto an end fitting to establish a rigid mechanical, torque transmitting coupling therebetween. Another object of this invention is to provide an improved apparatus for forming the end of a conductive metal tube onto an end fitting for connection to the end of a conductive metal tube by electromagnetically forming the tube end around the end fitting. Still another object of this invention is to provide an improved torque tube having fittings magnetically formed onto its ends and a high strength aluminum tube that is formed to the end fittings in the as-purchased condition without the need for supplemental heat treatment. A further object of this invention is to provide an improved process of transmitting torque from a driver at one end of a torque tube to a driven device at the other end of the torque tube wherein torque is transmitted through end fittings on the tube to the tubing material by virtue of the tubing material having been deformed around the fitting.

These and other objects of the invention are attained in an apparatus for electromagnetically pulse forming a conductive metal tube onto an end fitting at each end of the tube to establish a rigid mechanical, torque transmitting coupling therebetween. The end fitting is attached by inserting the end fitting into the center of the metal tube at one end thereof, the end fitting having one end portion with a torque coupling for connection to a driver, and an opposite end portion having a cross-sectional shape that is conducive for torque transmitting connection to the metal tube. The tube material is formed onto the one end of the metal tube around and against the end fitting, conforming the metal tube around the cross-sectional shape to form a torque transmitting connection to the metal tube.

DESCRIPTION OF THE DRAWINGS

The invention and its many attendant objects and advantages will become better understood upon reading the following description of the preferred embodiment in conjunction with the following drawings, wherein:

FIG. 35 is a plan view of the connecting shaft shown in FIGS. 23 and 31;

FIG. 36 is a side elevation of the connecting shaft shown in FIG. 35;

FIG. 37 is a side elevation of the gripper shown in FIG. 31; and

DESCRIPTION OF THE PREFERRED EMBODIMENT

Figure 1:
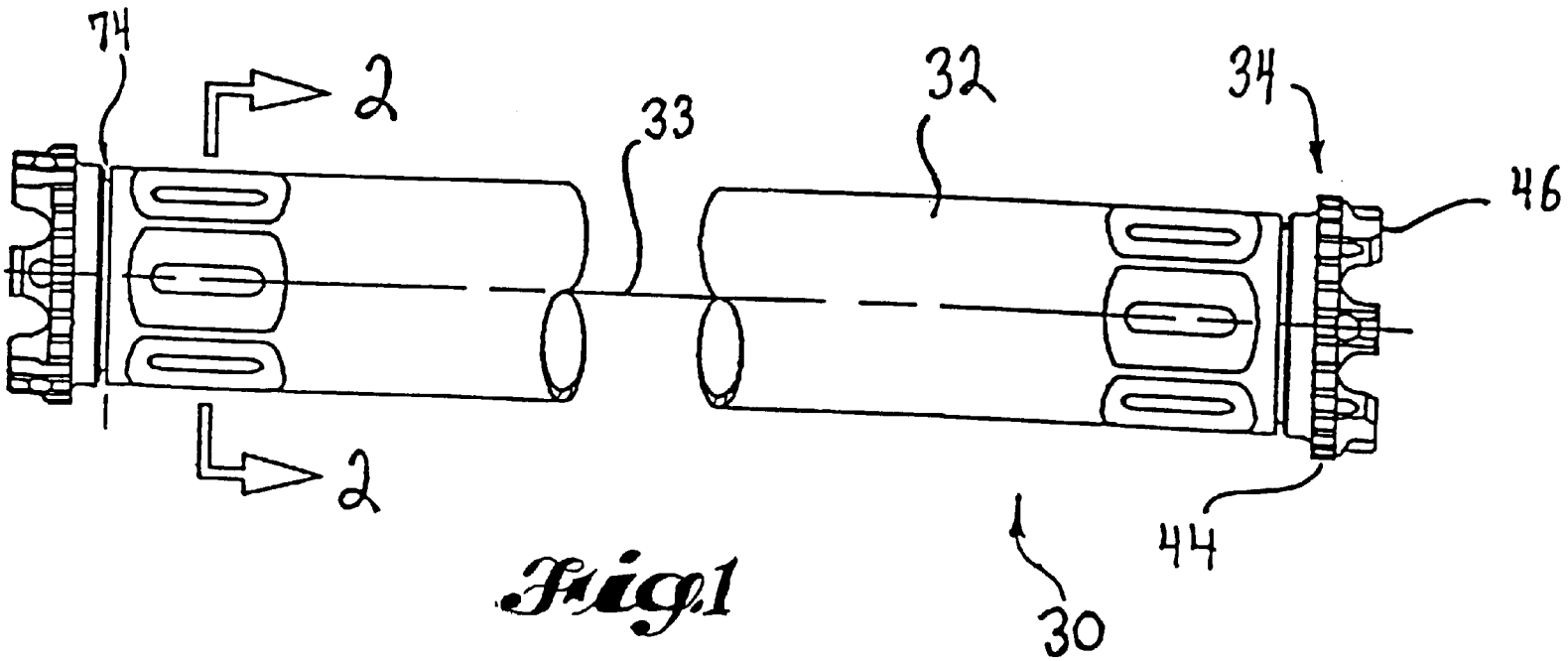
FIG. 1 is an elevation of a torque tube in accordance with this invention, shown with the center section broken out for clarity of illustration.
Figure 2:
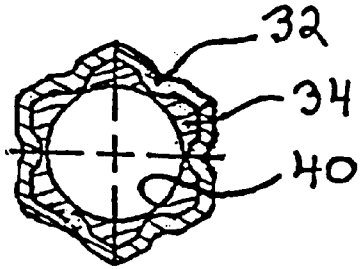
FIG. 2 is a cross section along lines 2—2 in FIG. 1.
Figure 3:
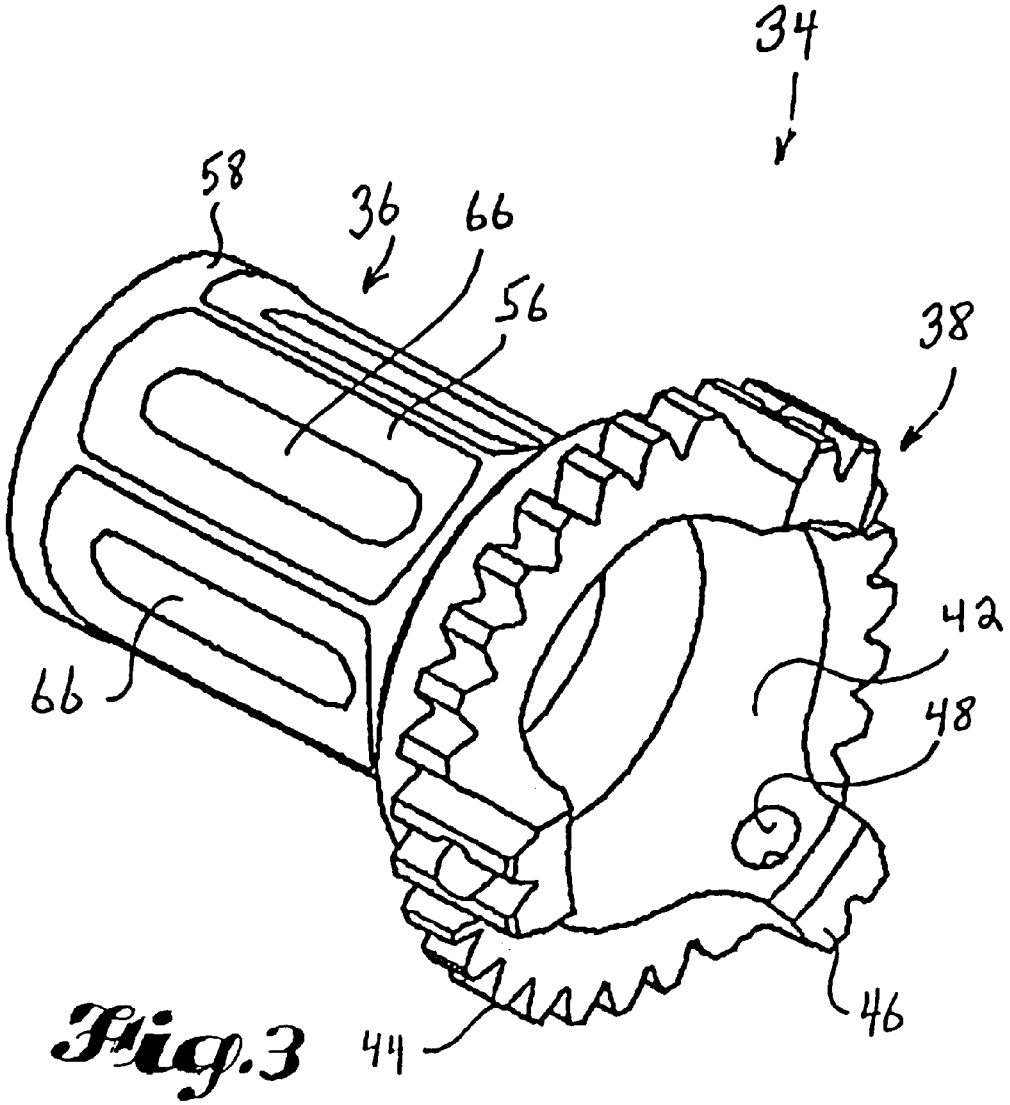
FIG. 3 is a perspective view of an end fitting used in the torque tube shown in FIG. 1.

Turning now to the drawings, wherein like reference characters designate identical or corresponding parts, and more particularly to FIGS. 1 and 2 thereof, a torque tube 30 made by the apparatus of this invention is shown having an elongated cylindrical tube 32 having a longitudinal axis 33, and an end fitting 34 fixed coaxially in the tube 32 at each end. The tube 32 is preferably 2024 aluminum, purchased from the supplier in the T-3 temper. Pesheney, an aluminum manufacturer in France, supplies 2024 tubing in various diameters and wall thicknesses that are suitable for use in these torque tubes, although other materials can be used, depending on the anticipated maximum loads, fatigue life and chemical environment the torque tube can be expected to encounter. The end fittings 34 are designed to be fixed in the ends of the tube 32 by forming the tube around the end fitting. A host of forming techniques are known and could be used for this purpose, such as swaging, hydroforming, explosive forming, etc. However, the preferred manufacturing technique for fixing the end fittings 34 in the ends of the tubes 32 is electromagnetic pulse forming, explained in detail below, which requires that the tube 32 be electrically conductive or, if not, must be provided with a conductive sleeve in which eddy currents can be magnetically induced in the forming process. If a conductive sleeve is used over a tube of material such as stainless steel having lower conductivity, the discussion below regarding the generation of opposing magnetic fields in the tube pertains to the conductive sleeve.

Figure 6:
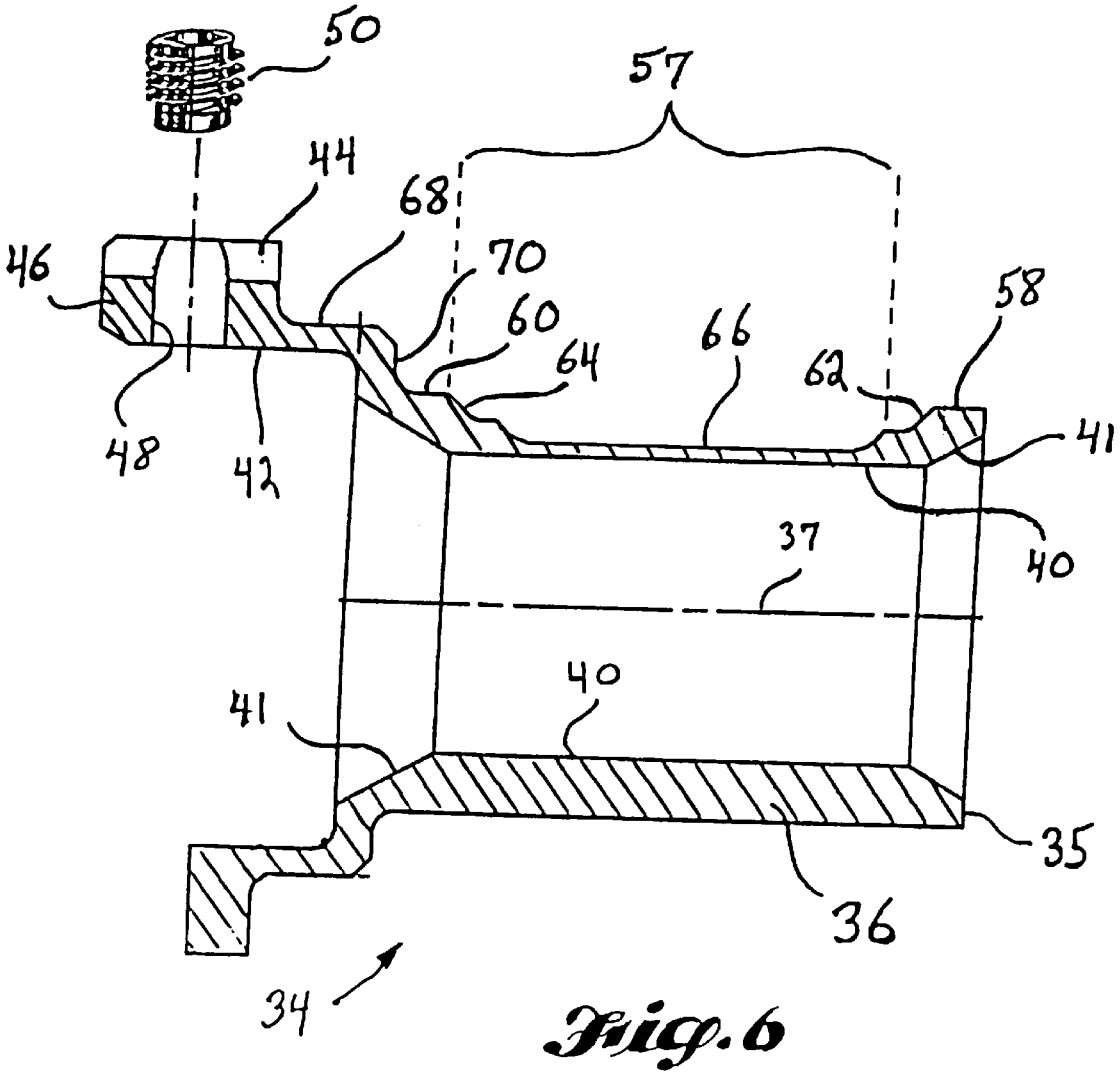
FIG. 6 is a sectional elevation along lines 6—6 in FIG. 5.
Figure 7:
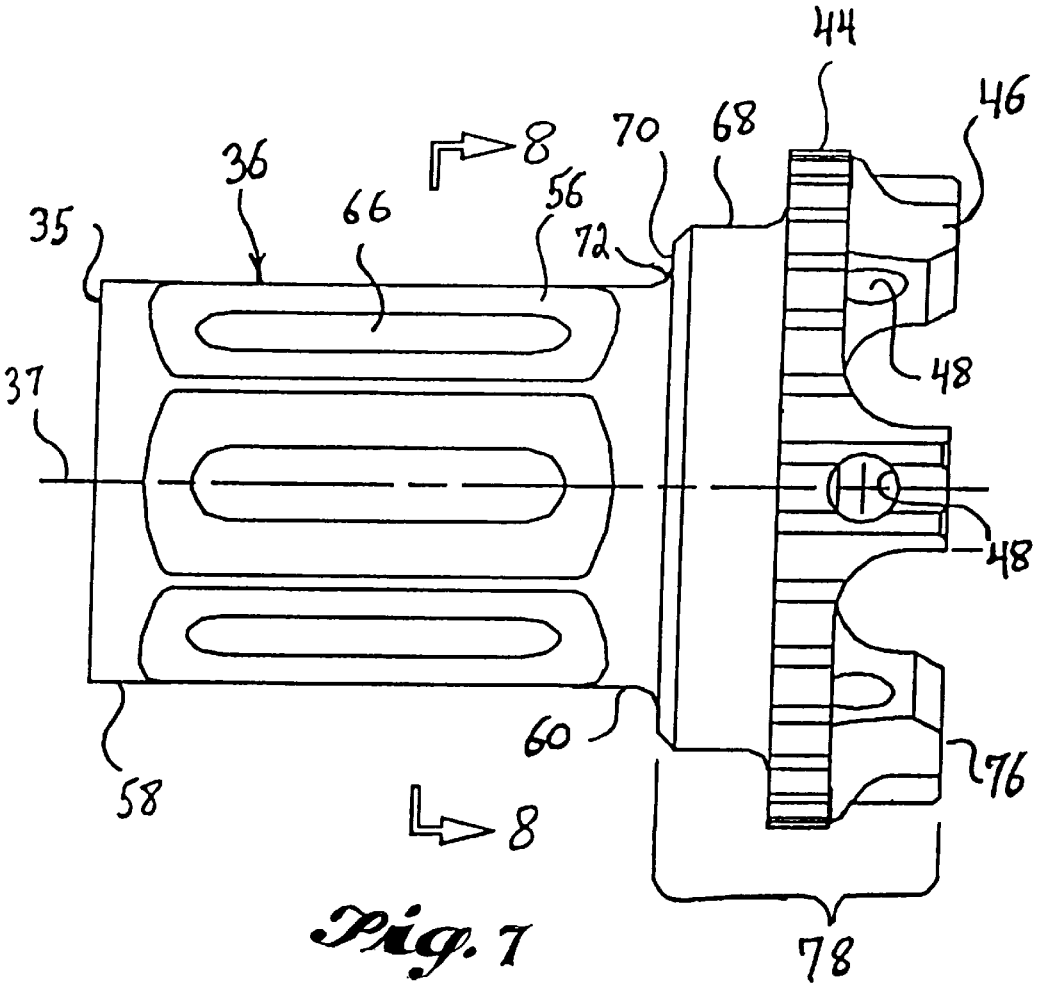
FIG. 7 is a side elevation of the end fitting shown in FIG. 4, rotated 30° from the position shown in FIG. 4.

The end fitting 34, shown in FIGS. 3–8, is preferably made of 15-5 stainless steel having 15% chromium, 5% nickel, 4% copper and the balance iron with less than about 1% carbon. Naturally, other materials could be used for the fitting 34, but 15-5 stainless steel is used because of its combination of corrosion resistance, machineability and strength. The fitting 34 has a tubular body 36 having an inner axial end 35 and a longitudinal axis 37 which, in the assembled torque tube 30, is coincident with the axis 33 of the tube 32. A torque coupling 38 is integral with the end fitting 34 at one axial end of the tubular body 36. An axial bore 40 extends through the tubular body 36, and is beveled at each end 41 to save weight. An enlarged counterbore 42, coaxial with the axial bore 40, extends through the torque coupling 38, as best shown in FIG. 6.

Figure 9:
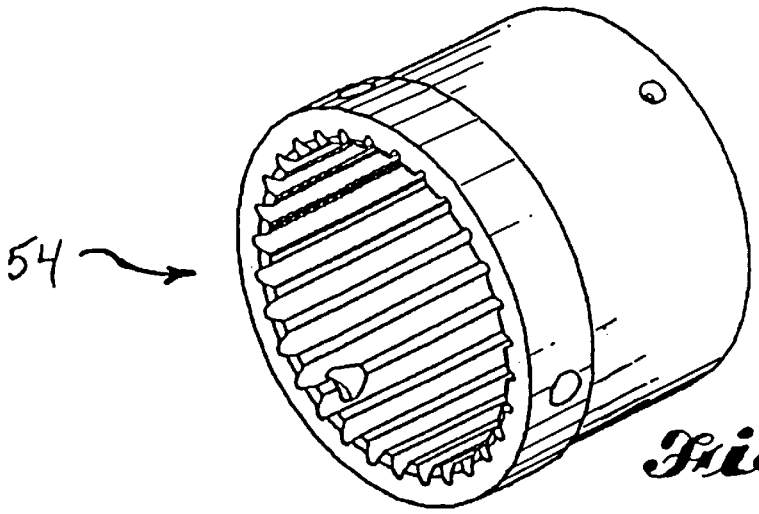
FIG. 9 is a perspective view of a coupling sleeve for torque-coupling the torque tube shown in FIG. 1 to a driven or driving apparatus.
Figure 10:
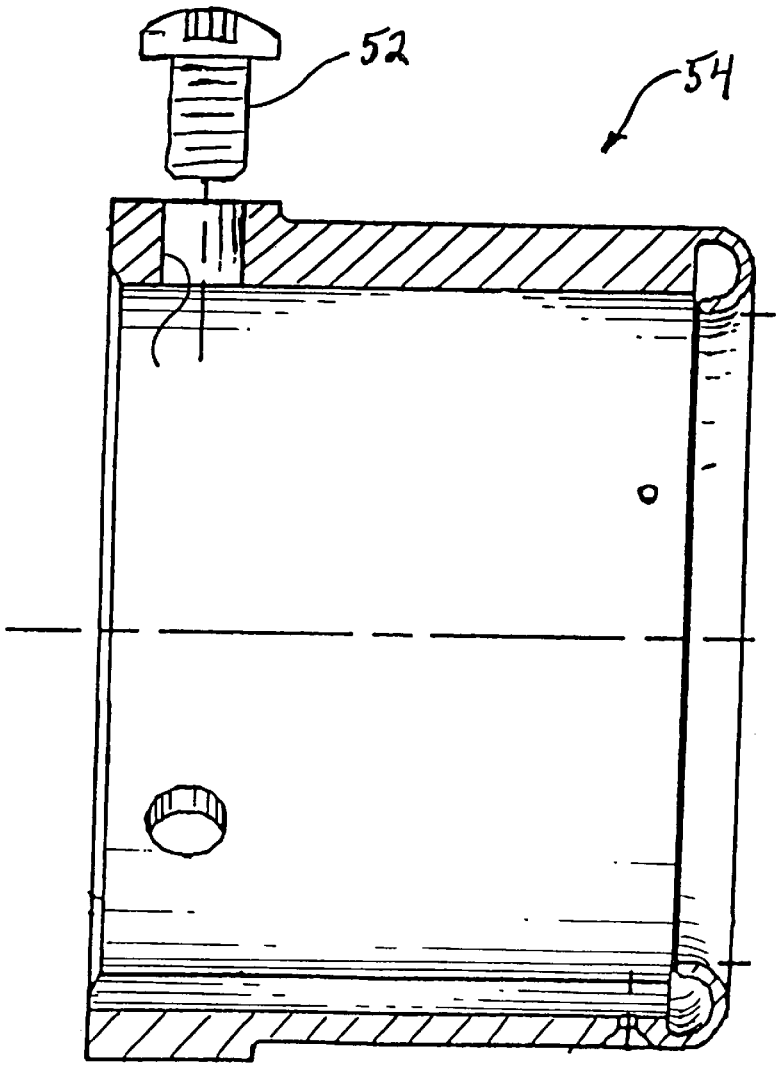
FIG. 10 is an enlarged sectional elevation of the coupling sleeve shown in FIG. 9.

Either or both torque couplings 38 on the end fittings at the two ends of the torque tube 30 could be components of a U-joint or other conventional coupling device, but the coupling 38 in this preferred embodiment is a splined annulus 44 having three axially protruding nubs 46 circumferentially spaced equally around the annulus 44. Each nub 46 has a radial hole 48 extending completely through the nub and communicating with the axial counterbore 42. Each hole 48 receives a threaded insert 50, shown in FIG. 6, to receive screws 52 for holding a coaxial, internally splined sleeve 54 axially in place around the splined annulus 44. The sleeve 54, illustrated in FIGS. 9 and 10, couples the torque tube 30 to a driving or driven gear in the mechanical system in which it operates. For example, in the leading edge of an airplane wing, the torque tube 30 is driven by a hydraulic motor and drives a pinion gear for driving a gear rack when the leading edge slats are to be extended or retracted for take-off and landing. The sleeve 54 enables the torque tube 30 to flex angularly with respect to the driving gear or coupled mechanism while remaining in torque-coupled relationship thereto, and also permits a limited degree of axial displacement of the torque tube 30 to accommodate wing deflection in flight.

Figure 4:
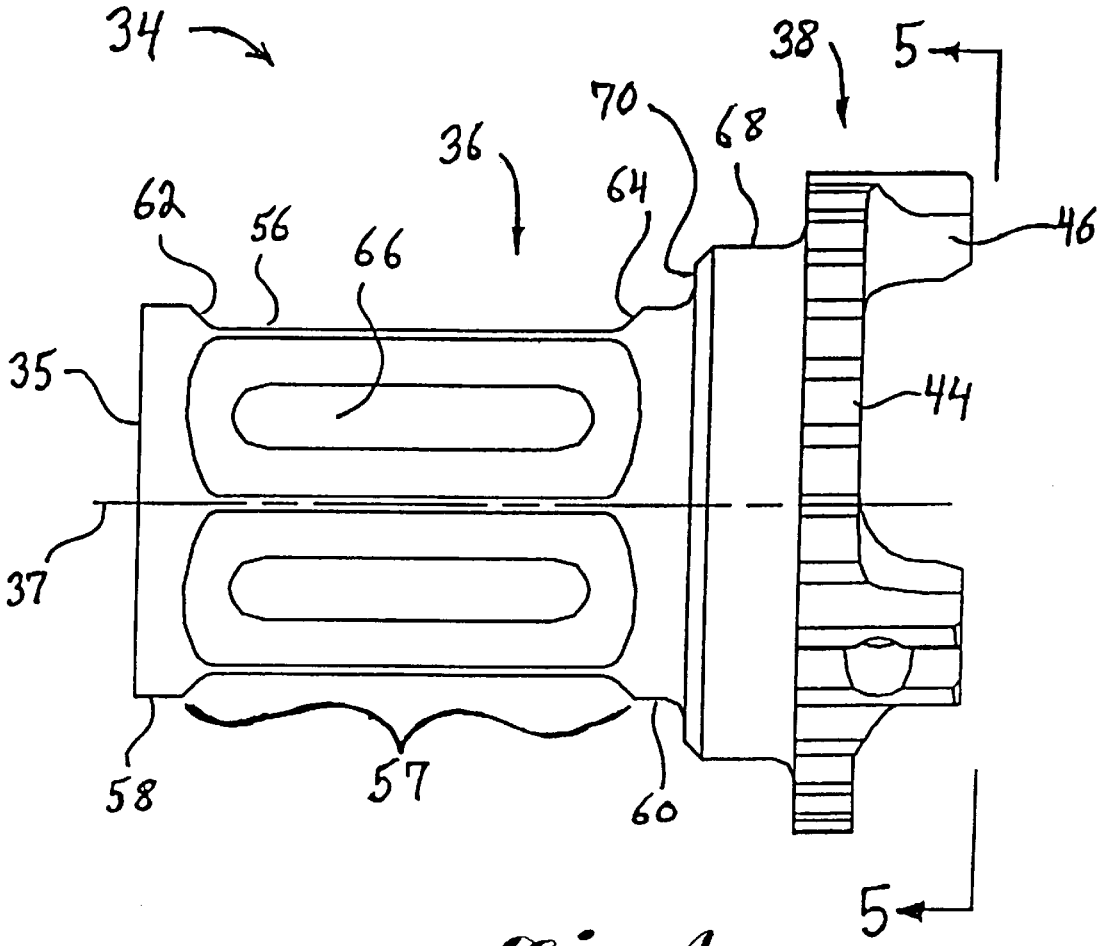
FIG. 4 is a side elevation of the end fitting shown in FIG. 3.
Figure 5:
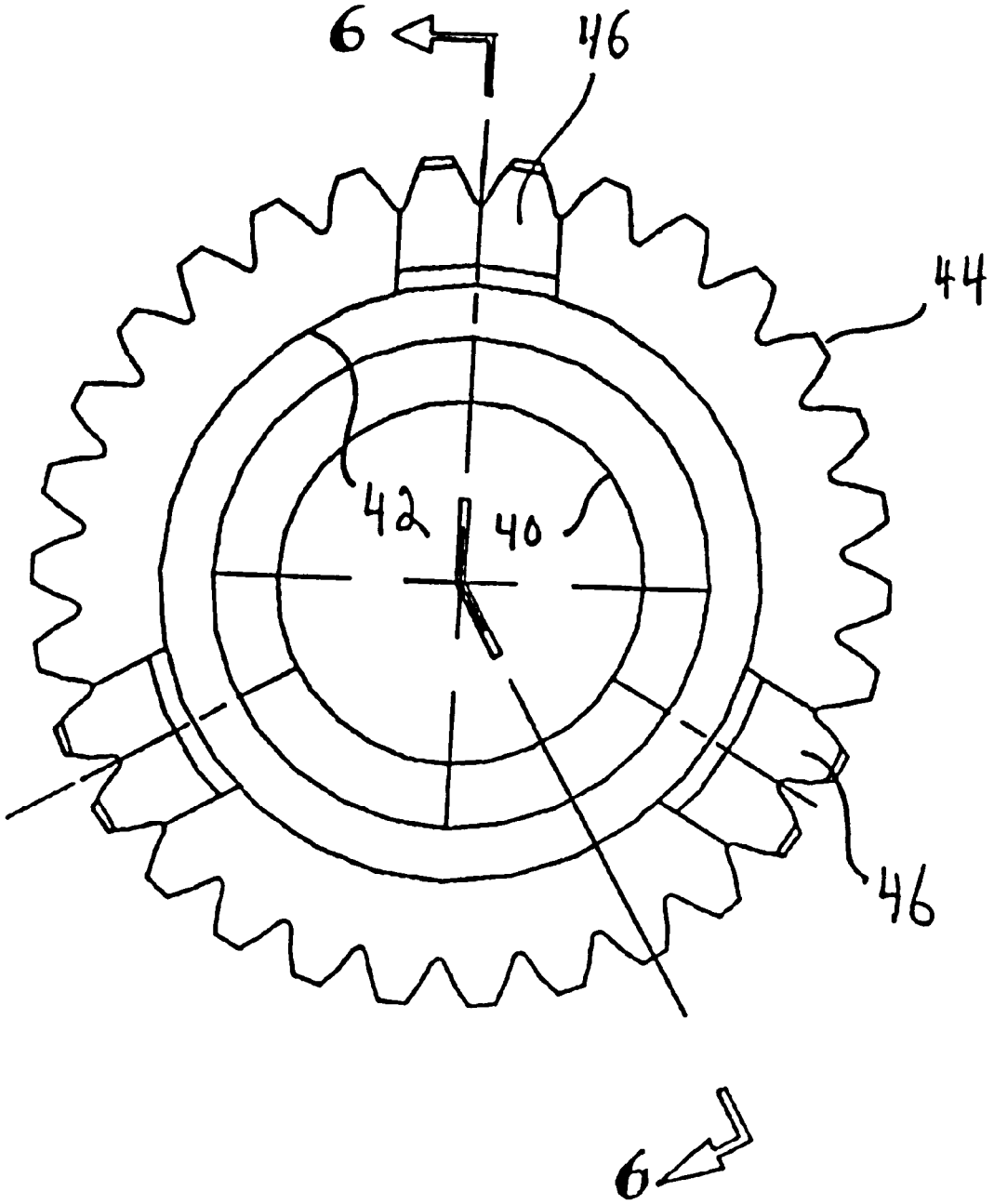
FIG. 5 is an end elevation along lines 5—5 in FIG. 4.
Figure 8:
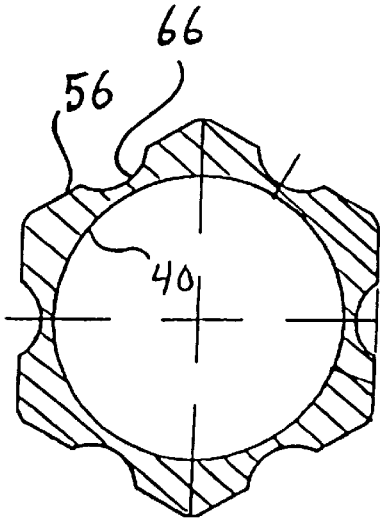
FIG. 8 is a sectional end elevation along lines 8—8 in FIG. 7.

As shown best in FIG. 4, six flat lands 56 are milled onto the surface of the center section 57 of the tubular body 36, forming a cross section through the axis 37 approximately in the form of a regular polygon, preferably a hexagon, as illustrated in FIG. 8. The flat lands 56 terminate axially short of both ends of the tubular body 36, leaving the two end portions of the tubular body 36, each in the form of a circular cross-section cylinder extending axially slightly beyond the hexagonal center section, providing an end supporting surface 58 and a center supporting surface 60 for the tube 32 on both axial ends of the flat lands 56 when the tube is electromagnetically pulse formed down into the flat lands 56. The axial ends of the flat lands 56 blend onto the supporting surfaces 58 and 60 with sloping shoulders 62 and 64, respectively, lying at an angle of between 30–55°, preferably about 45° from the horizontal, around which the 2024 aluminum of the tube 32 can be formed in the T-3 condition without cracking. Electromagnetically forming the aluminum tube 32 onto the hexagonal center section 57 of the end fitting 34 establishes a torque transmitting joint between the end fitting 34 and the tube 32 that is stronger torsionally than the tubing material itself. Axial load transmission between the tube 32 and the end fitting is established by engagement of the shoulders 62 and 64 on the end fitting with portions of the tube 32 formed over the shoulders.

A groove 66 is milled into the flat face of each land 56 as shown best in FIGS. 6 and 8. The groove 66 is a simple circular cross-section groove cut with a simple spherical end cutter. The groove 66 provides a runout region for the tube 32 to expand into when it is electromagnetically formed around the end fitting 34 so it does not rebound away from the flat face of the lands 56 by springback or reflection. This ensures that the tube material remains under slight tension after it is formed around the end fitting 34, so it retains a slight hoop stress and maintains a tight torsional joint on the end fitting 34.

The dimensions of the groove 66 are not critical and need not be held to close tolerances, so the machining on the groove is not a costly operation. However, the shape of the groove 66 should be conducive to receiving the tube material as it is impulse formed onto the fitting 34 and avoid any sharp bends or folds of the material when it forms down into the grooves 66. The radius of curvature of the circular groove 66 should be greater than about 10% of the radius of the axial bore 40, and less than one third of the point-to-point dimension of the face of the hexagonal surface in which the groove is formed. These proportions militate for a groove 66 that is big enough to receive the runout of the tube when it forms down against the end fitting 34 without a sharp bend at the edge of the groove 66 and without excessively thinning the floor of the groove 66 which could weaken it to the degree that it could deform during forming.

The splined annulus 44 extends radially from an enlarged diameter step 68 at the inner end of the tubular body 36. The step 68 forms a shoulder 70 with the tubular body 36 at the junction with the center cylindrical supporting surface 60. When the fitting 34 is inserted into the tube 32, the tubular body 36 is slid all the way into the tube 32 as far as it will go. The end of the tube 32 does not actually engage the shoulder 70 because a fillet 72 at the corner of the end fitting 34 where the center cylindrical supporting surface 60 meets the shoulder 70 engages the inside peripheral edge of the tube end before the tube end reaches the shoulder 70, so a small gap 74 remains between the shoulder 70 and the axial end of the tube 32. The fillet 72 avoids creating a stress riser at that inside corner, and the gap 74 provides a space in which sealant can be applied and retained to seal the interface between the end fitting 34 and the tube 32. The protruding nubs 46 have axial end faces 76 which are machined precisely to give the distal end portion 78 of the end fitting 34, indicated in FIG. 7 as that portion between the shoulder 70 and the axial end faces 76 of the protruding nubs 46, a known dimension that is useful for forming the second end of the tube 32 onto an end fitting 34 after the first end has been formed on a forming apparatus 100, to be described below.

The forming apparatus 100, shown in FIGS. 11–17, performs the process of electromagnetically forming the aluminum tubing 32 onto end fittings 34 to manufacture the torque tubes 30 in accordance with this invention. This apparatus could also be used for manufacturing other types of tubes with end fittings and even for down-sizing tube ends. It is fast, easy to use, safe, quiet, reliable, repeatable and is capable of production at a sustained rate.

Figure 11:
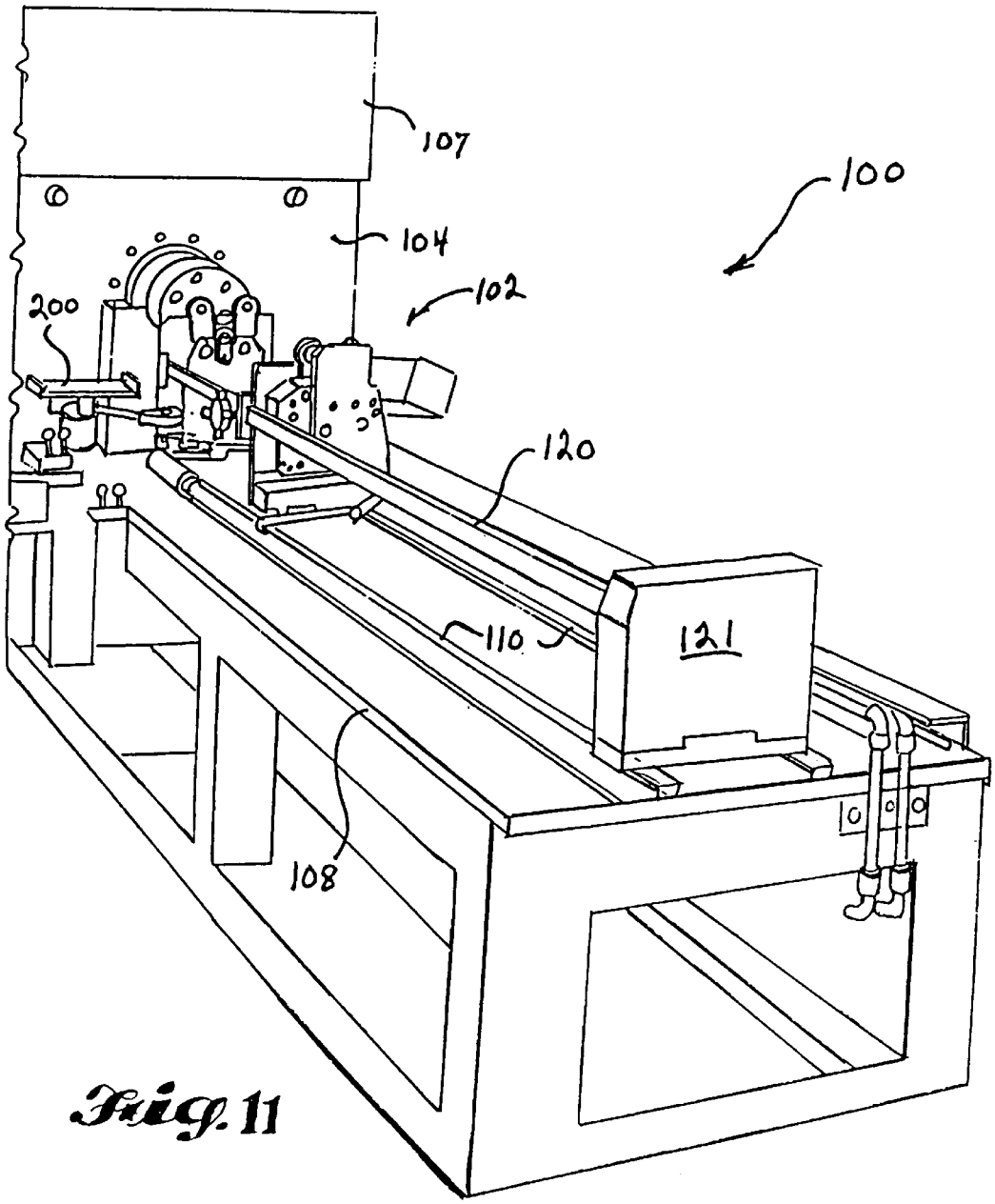
FIG. 11 is a perspective view of an apparatus for forming tubing material onto end fittings using a process to make torque tubes in accordance with this invention.
Figure 15:
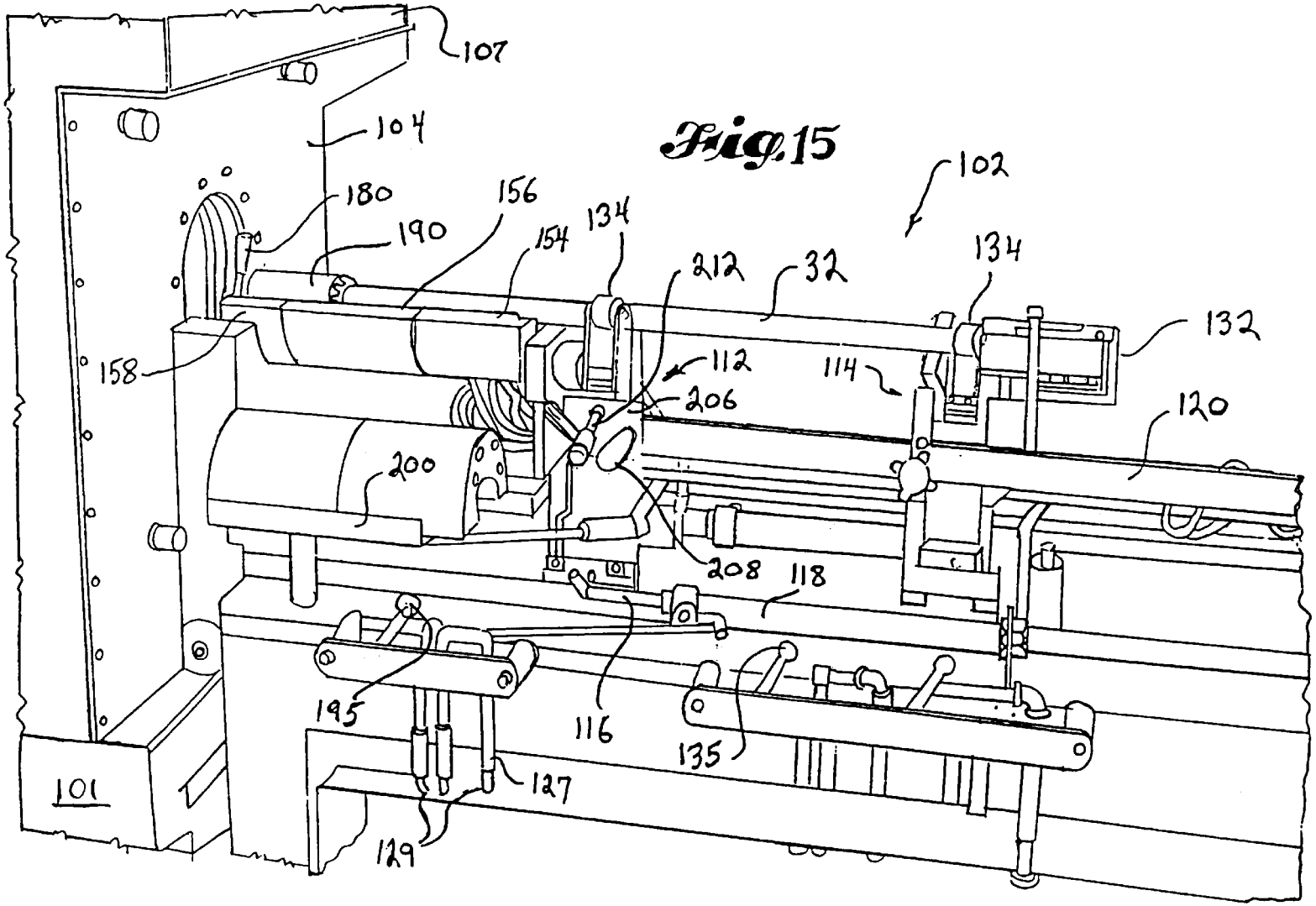
FIG. 15 is a perspective view of the front end of the tube support assembly and main coil shown in FIGS. 11 and 12.

As illustrated best in FIGS. 11 and 15, the apparatus 100 includes a tube support assembly 102 for holding the tube 32 while the end fitting 34 is inserted and properly positioned in the end of the tube 32 and for moving the tube 32 and the installed end fitting 34 into an opening 103 in a main coil 104 where the tube is electromagnetically formed onto the end fitting 34 with electrical power supplied through a conduit 105 from a power supply cabinet 106 holding a power supply, a capacitor bank, and electronic controls for powering the main coil 104. Power from the capacitors in the cabinet 106 is delivered along fifteen cables in the conduit 105 to a power bus in a housing 107 atop the main coil 104, to which the power bus is electrically connected. A chiller 109 cools a coolant that is pumped through cooling channels in the main coil 104 to remove heat generated during operation of the apparatus 100. The main coil 104 and power supply cabinet 106 (and associated components) are available commercially from Elmag, Inc. of San Diego, Calif. as the "Magnepuls" Electromagnetic Energy Pulse System.

The tube support assembly 102 includes an elongated table 108 on which two pairs of rails 110 are mounted for supporting a front carriage 112 and a rear carriage 114 for longitudinal translation on the rails 110. Two piston rods 116 on pistons in double acting air cylinders 118, one on each side of the table 108 and extending along the longitudinal edges of the table, are connected to the front carriage 112 for longitudinal movement along the rails 110. A connecting bar 120 is fastened between the front carriage 112 and the rear carriage 114 to ensure that both carriages 112 and 114 move together. The rear end of the connecting bar 120 is supported on a traveling block 121. A hand wheel 122 on a clamp bolt threaded into a U-bracket 124 on the rear carriage 114 permits the spacing between the front and rear carriages to be adjusted. Wheels 123 support the front and rear carriages 112 and 114 and the traveling block 121 for smooth linear motion along the rails 110.

Figure 14:
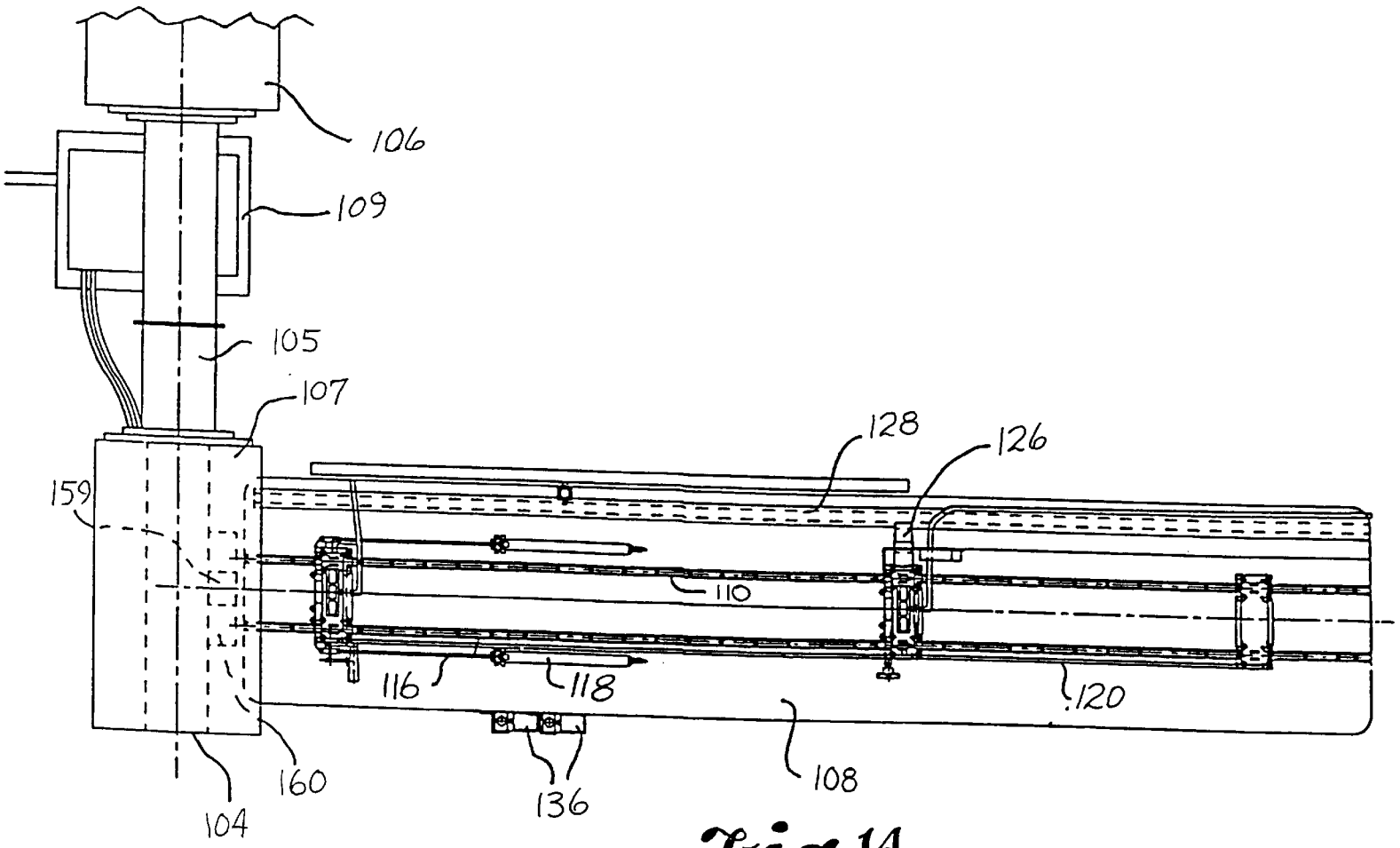
FIG. 14 is a partial plan view (omitting the power cabinets) of the apparatus shown in FIGS. 11 and 12.
Figure 16:
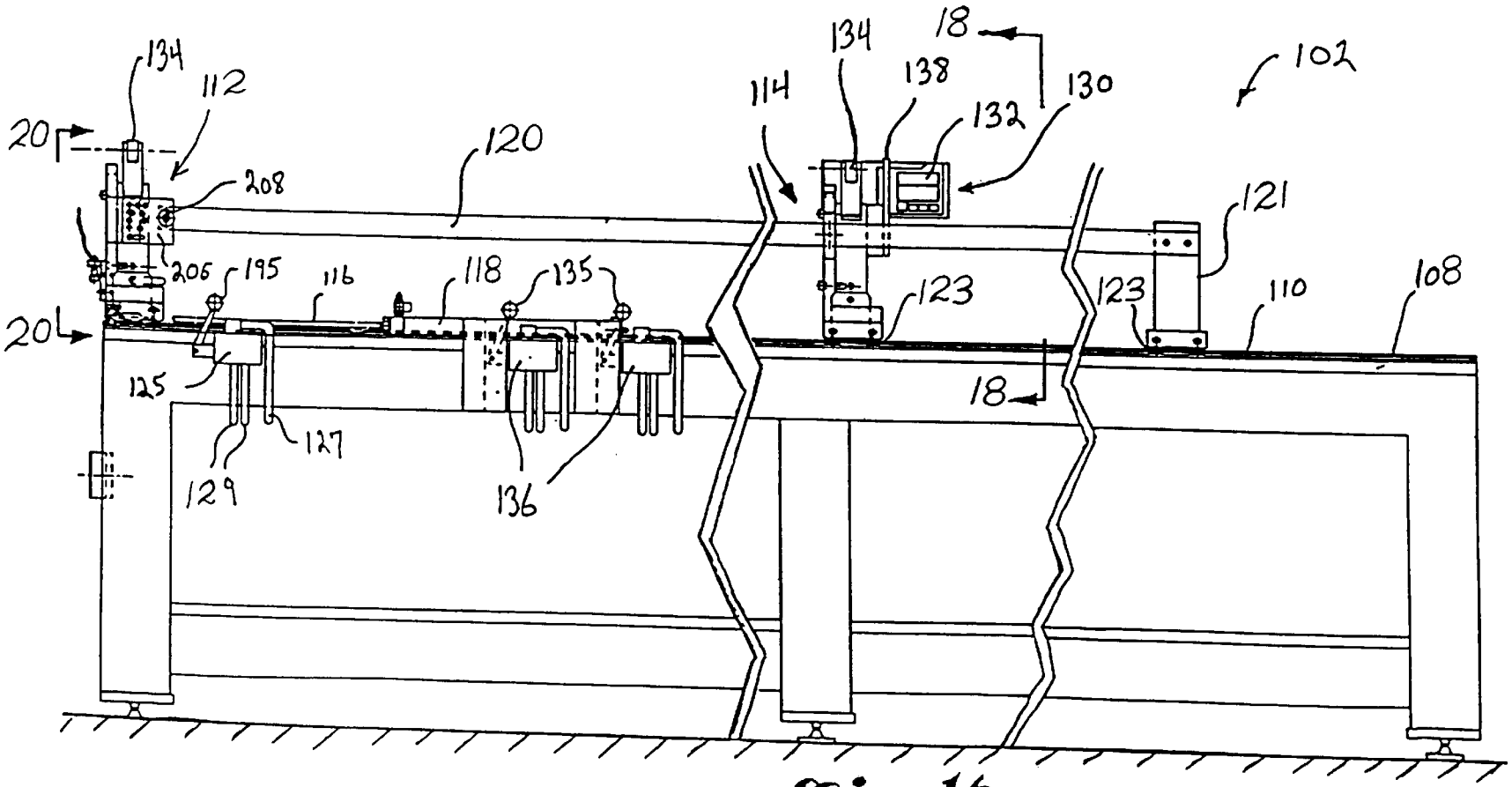
FIG. 16 is a side elevation of the tube support table shown in FIGS. 12 and 14.
Figure 17:
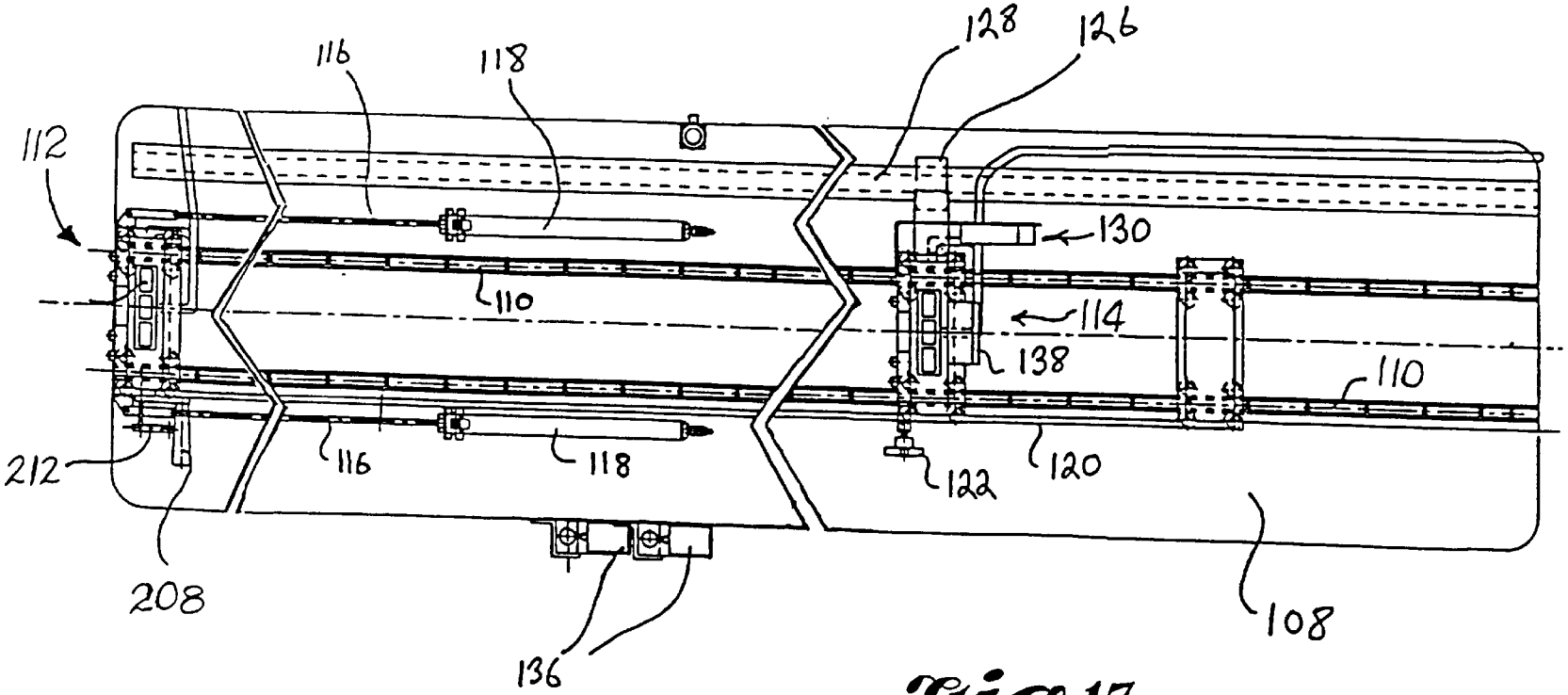
FIG. 17 is a plan view of the tube support table shown in FIG. 16.
Figure 18:
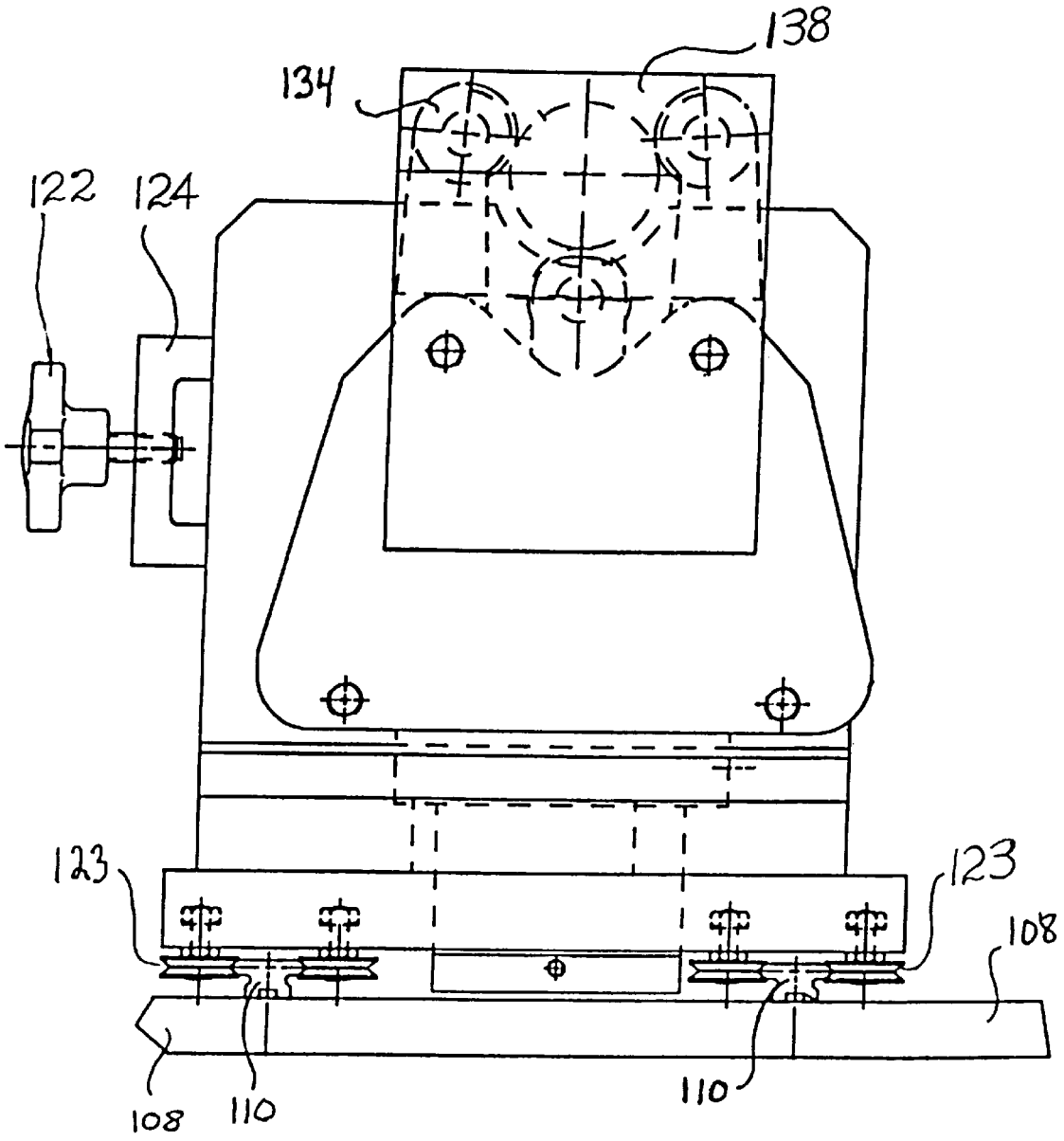
FIG. 18 is an end elevation of the rear carriage viewed along lines 18—18 in FIG. 16.
Figure 19:
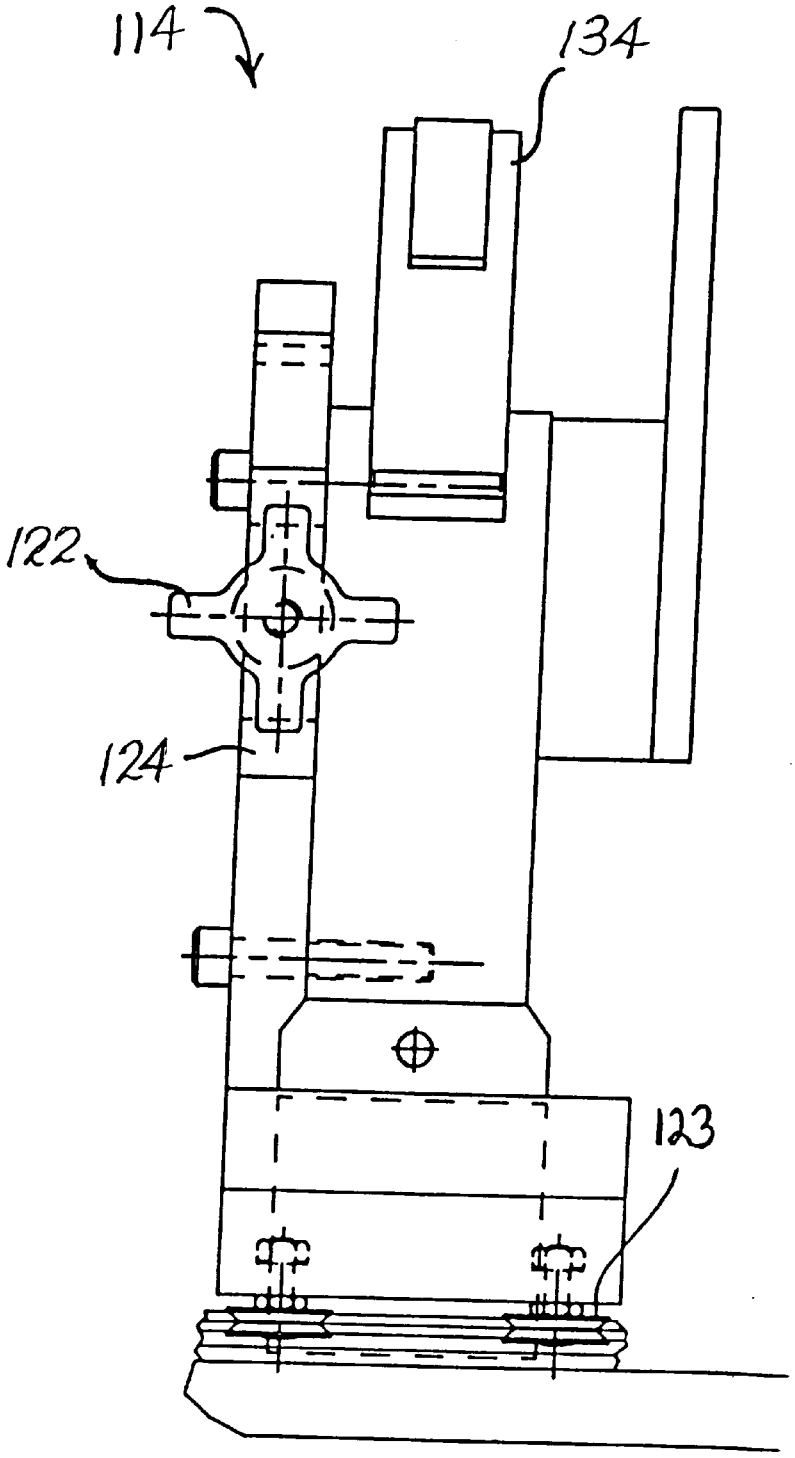
FIG. 19 is a front elevation of the rear carriage shown in FIG. 18.

A control valve 125, best shown in FIG. 16 controls the flow of air under pressure from an air pressure source through a supply line 127 to air lines 129 to a selected end of the air cylinders 118 so the carriages may be driven in either direction by operating the control valve in one direction or the other. A sensor 126 projecting from the back side on the rear carriage 114 as shown in FIG. 14, engages a longitudinal scale 128, such as the "Pro-Scale" #210-10 available from Accurate Technology, Inc. in Kirkland, Wash. A digital indicator 130 on a display 132 indicates the longitudinal position of the rear carriage 114 as sensed by the sensor 126.

Each carriage 112 and 114 includes a self-centering, pneumatically actuated three-roller tube clamp 134 such as the Autoblock #MWR 21/75 commercially available from Reynolds Machine and Tool Co., in Melrose Park, Ill. The tube clamps 134 are mounted atop the carriages 112 and 114 for gripping and centering the tube 32 when valve handles 135 on a pneumatic control assembly 136 are moved. The use of self-centering clamps 1345 allows all sizes of the tube 32 to be loaded on their respective centerlines so the tube always aligns with the center of the forming coil 104, to be described below, and allows rotation of the tubing after clamping. A back stop 138 is mounted on the rear carriage 114 intersecting the axis of the tube clamps 134 to provide a reference surface against which the tube 32 can be abutted. The known length of the tube 32 can be used with the longitudinal scale 128 and sensor 126 to accurately position the end of the tube 32 relative to the nested end fitting 34 in the main coil 104, as is explained below.

Figure 22:
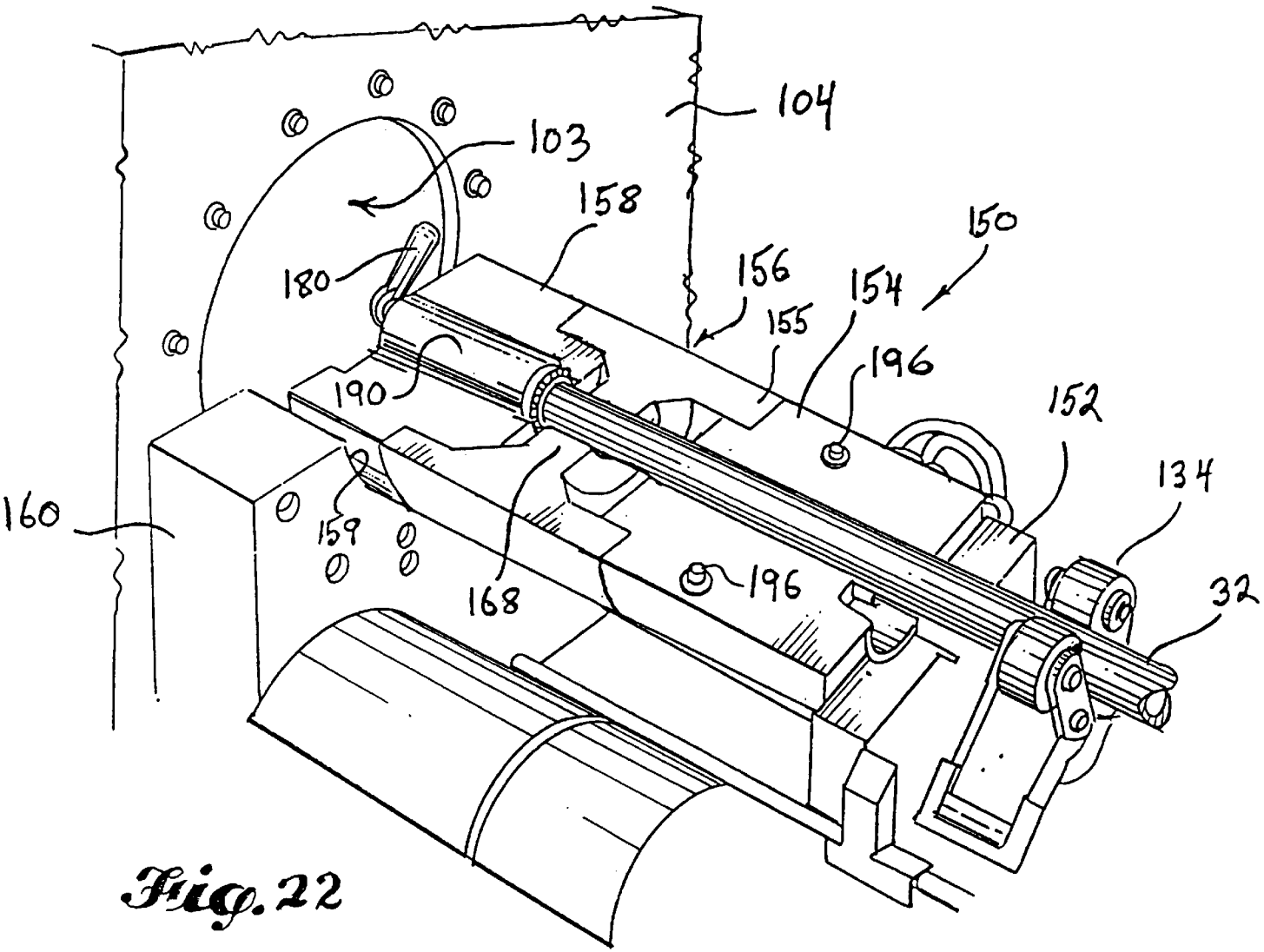
FIG. 22 is a perspective view of the front end of the forming apparatus, with the top half of the connected insulator block and field concentrator lifted off.
Figure 23:
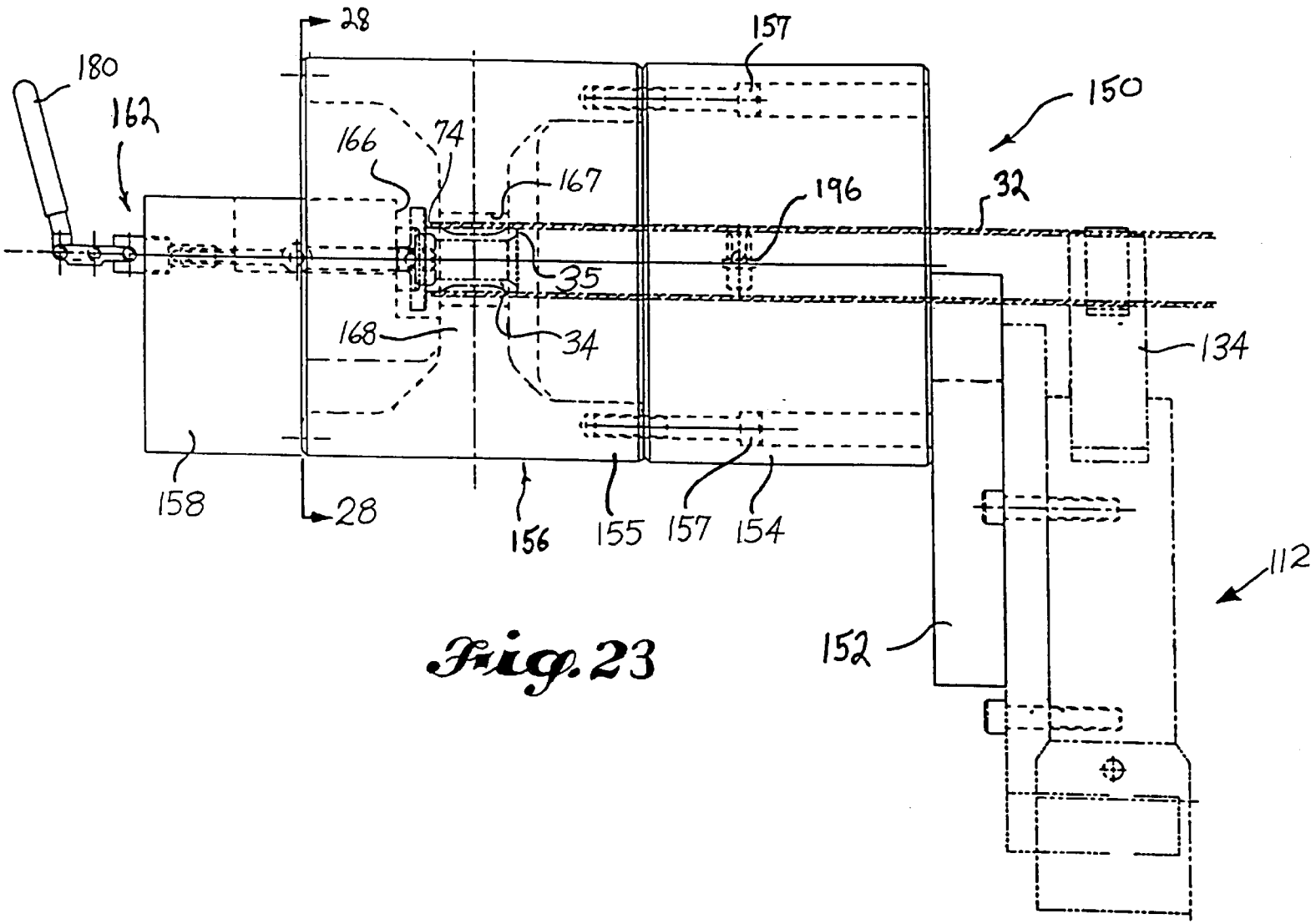
FIG. 23 is an enlarged elevation, partly in section, of the tube locator assembly attached to the front carriage, as shown in FIG. 12.
Figure 24:
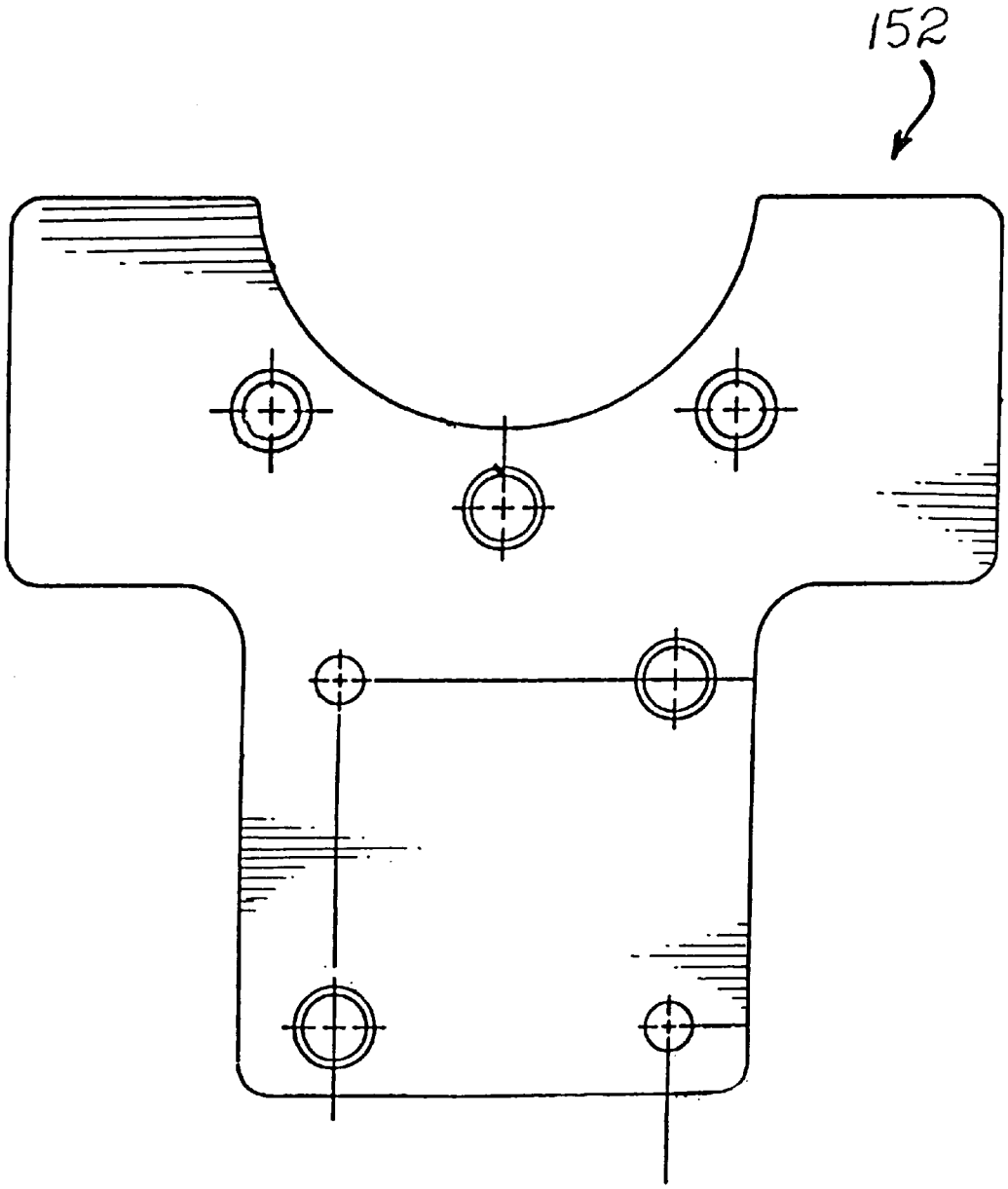
FIG. 24 is an enlarged end elevation of the attachment block shown in FIG. 23.

A tube locator assembly 150, shown in FIGS. 22 and 23, includes an attachment block 152 by which the tube locator assembly 150 is attached to the front carriage 112, and an insulator block 154 fastened at one end to the attachment block 152. The insulator block is made of some suitable nonconductive material such as ultra-high molecular weight polyethylene, which is not only a good electrical insulator and a durable material, but also withstands the harmonics created by the electromagnetic forming pulse better than phenolics normally used in applications of this kind.

Figure 28:
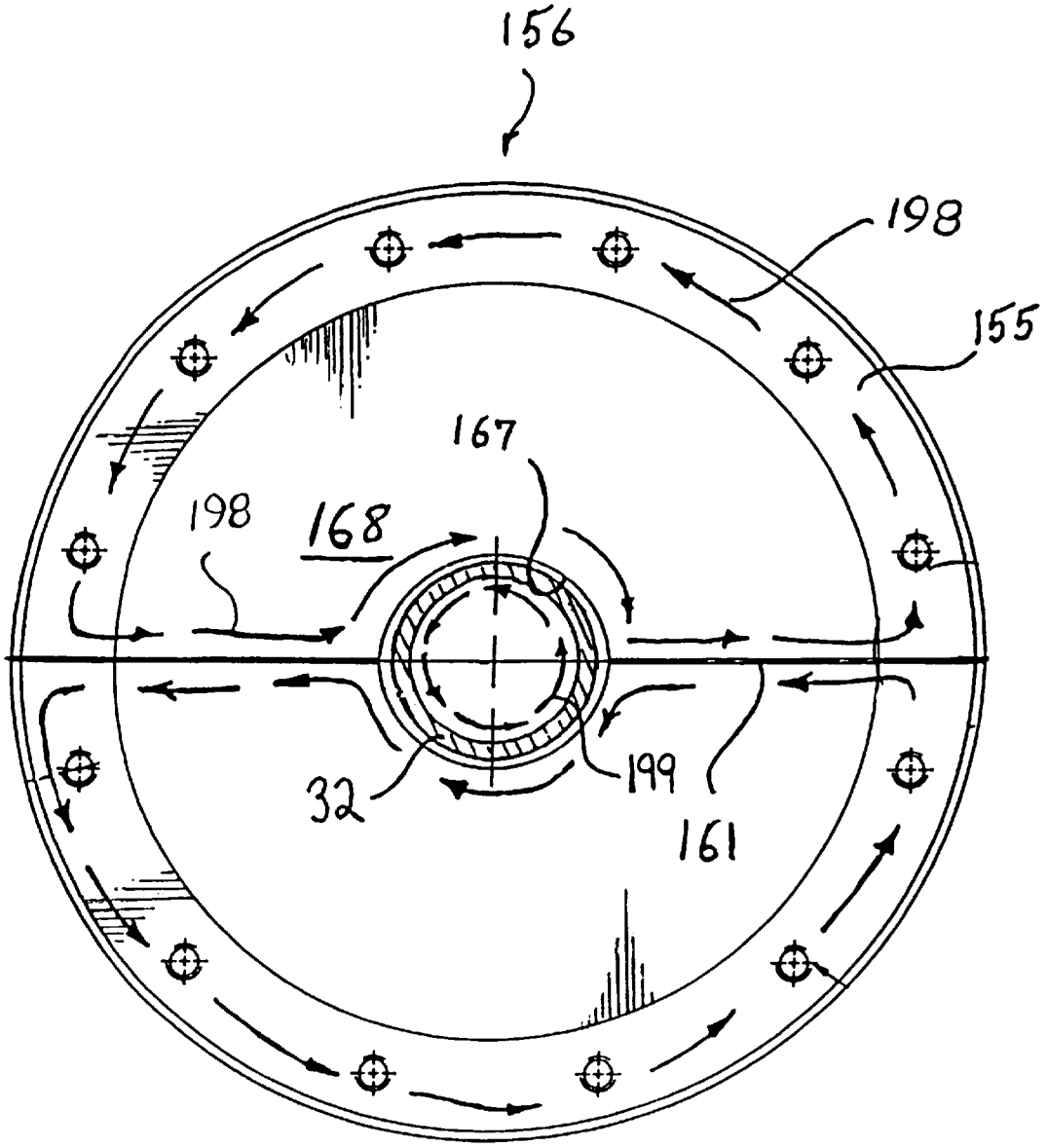
FIG. 28 is an end elevation of the field concentrator viewed along lines 28—28 in FIG. 23, with the tube locator block and the tube and end fitting removed for clarity.
Figure 29:
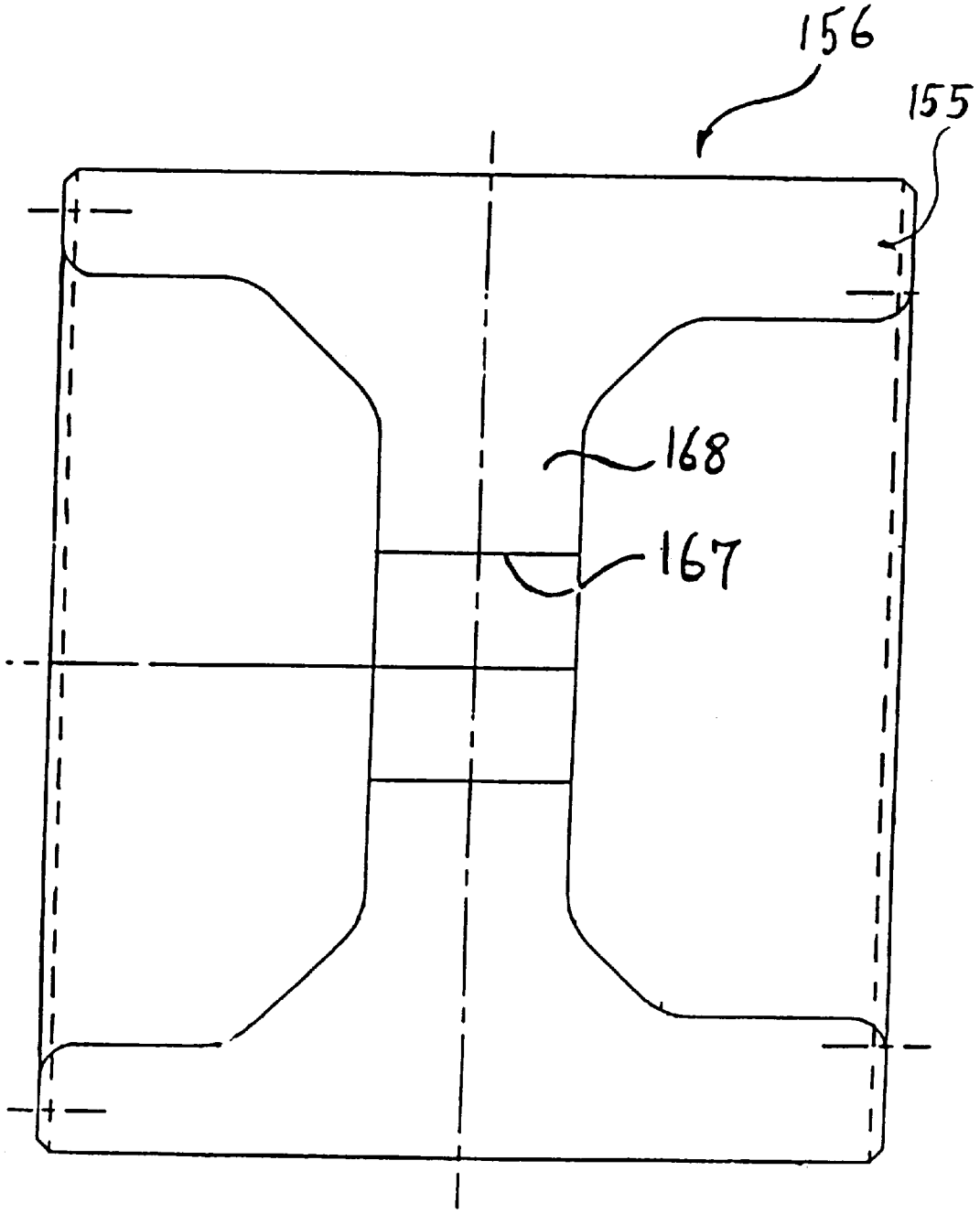
FIG. 29 is a plan view of the field concentrator shown in FIG. 23.
Figure 30:
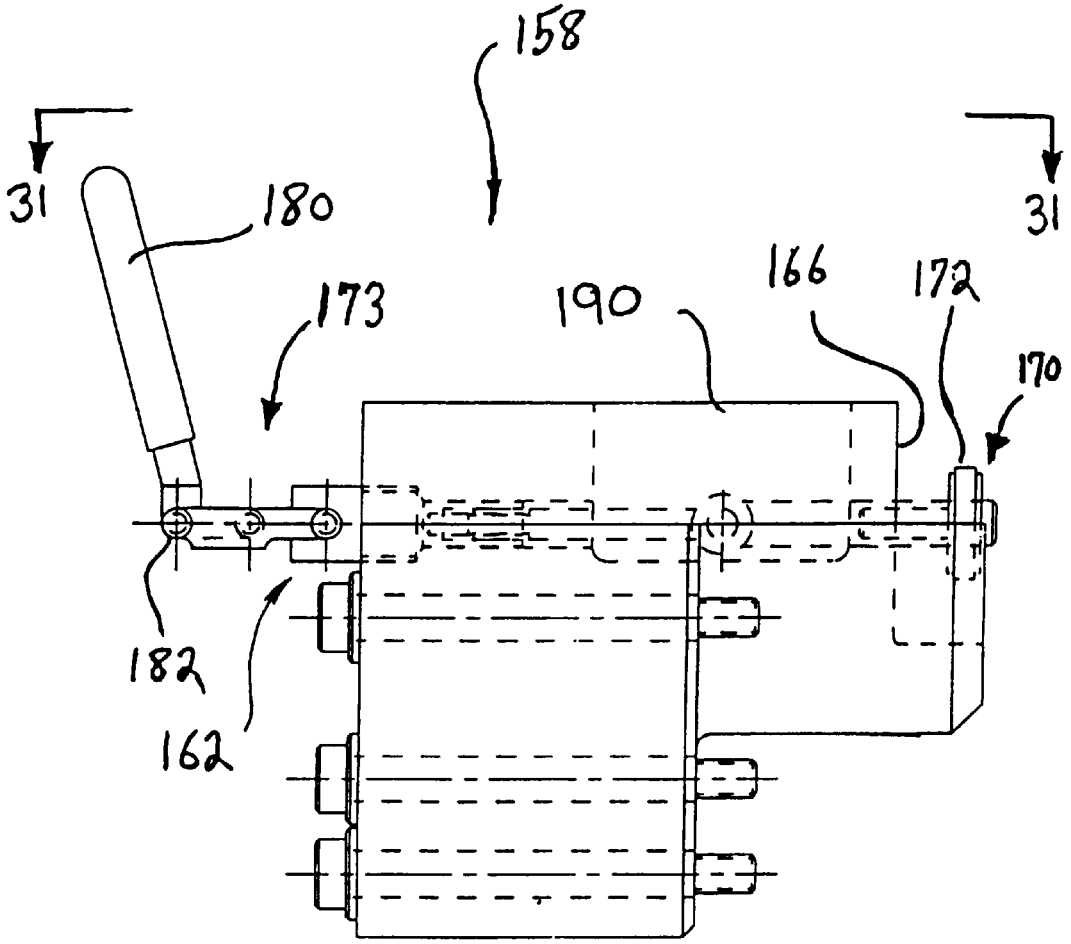
FIG. 30 is an enlarged view, partly in phantom, showing the tube locator assembly shown in FIG. 23.
Figure 31:
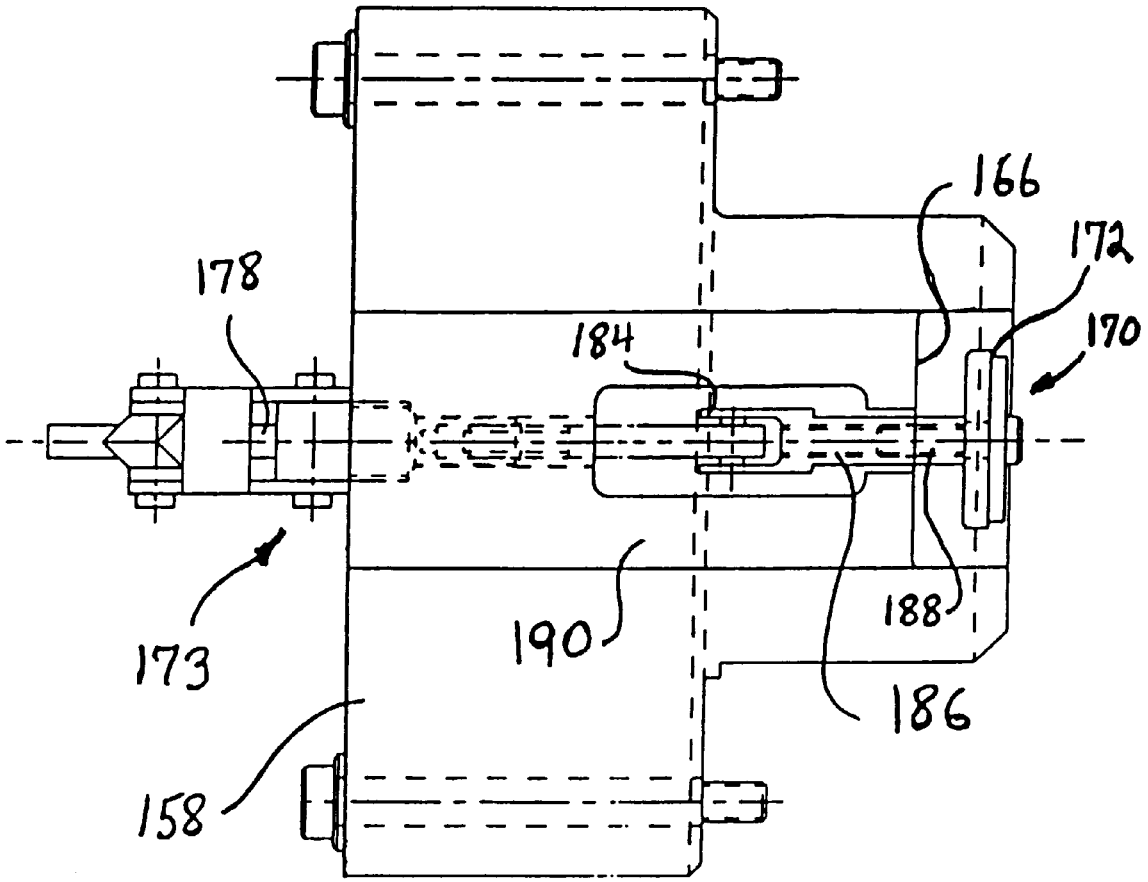
FIG. 31 is a plan view along lines 31—31 in FIG. 30.
Figure 32:
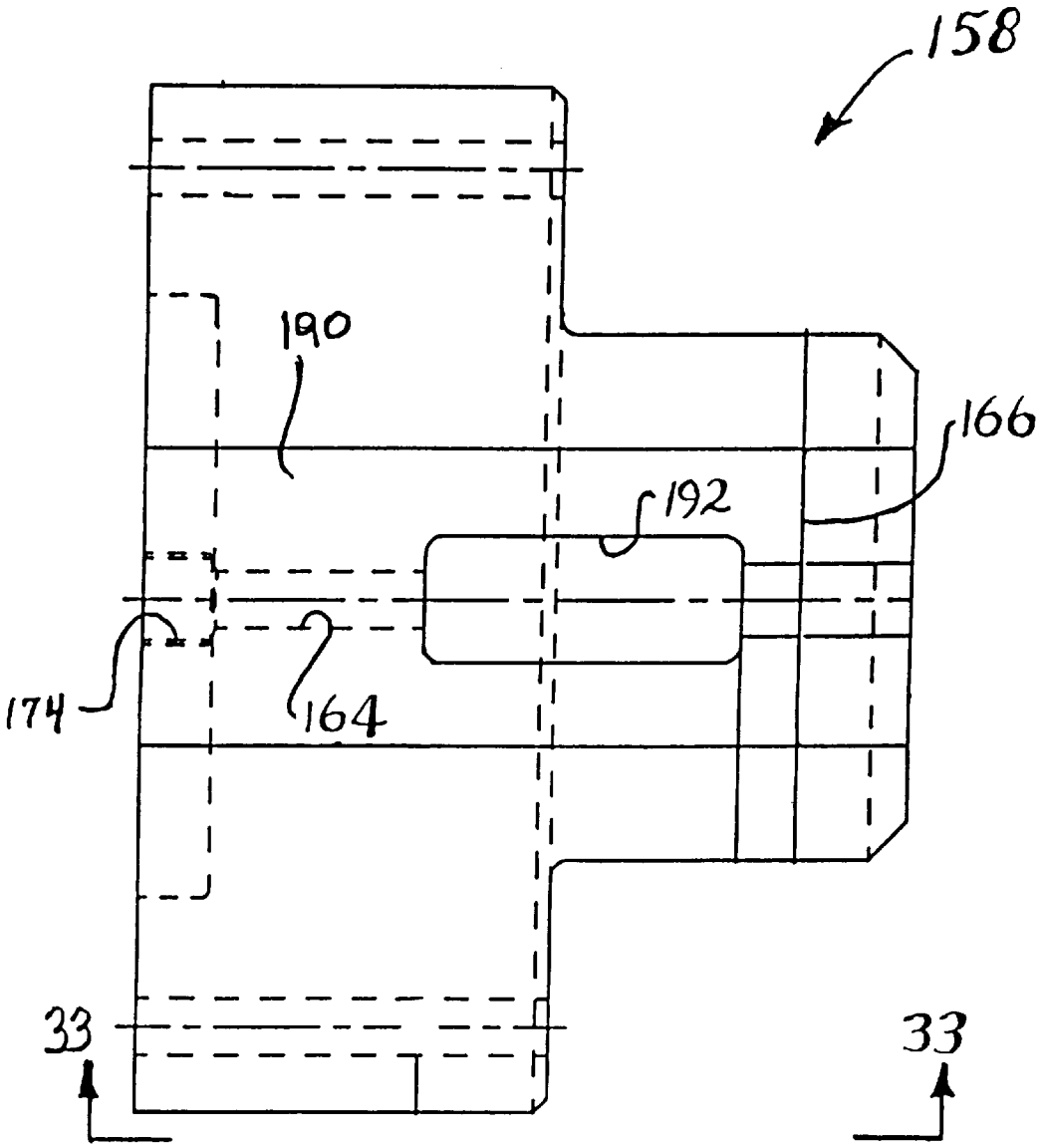
FIG. 32 is an enlarged plan view on the locator block shown in FIG. 31.
Figure 33:
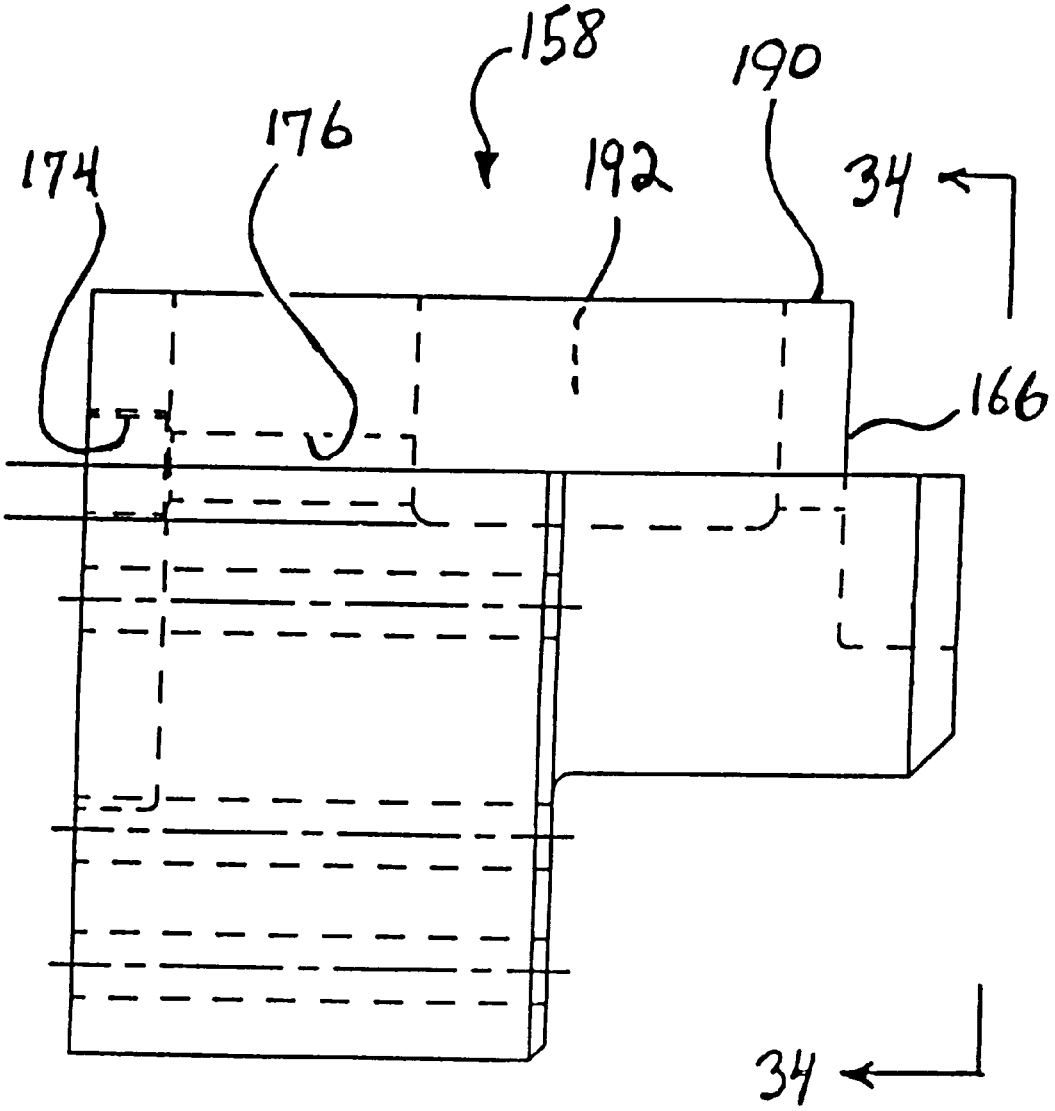
FIG. 33 is a side elevation of the locator block along lines 31—31 in FIG. 32.
Figure 34:
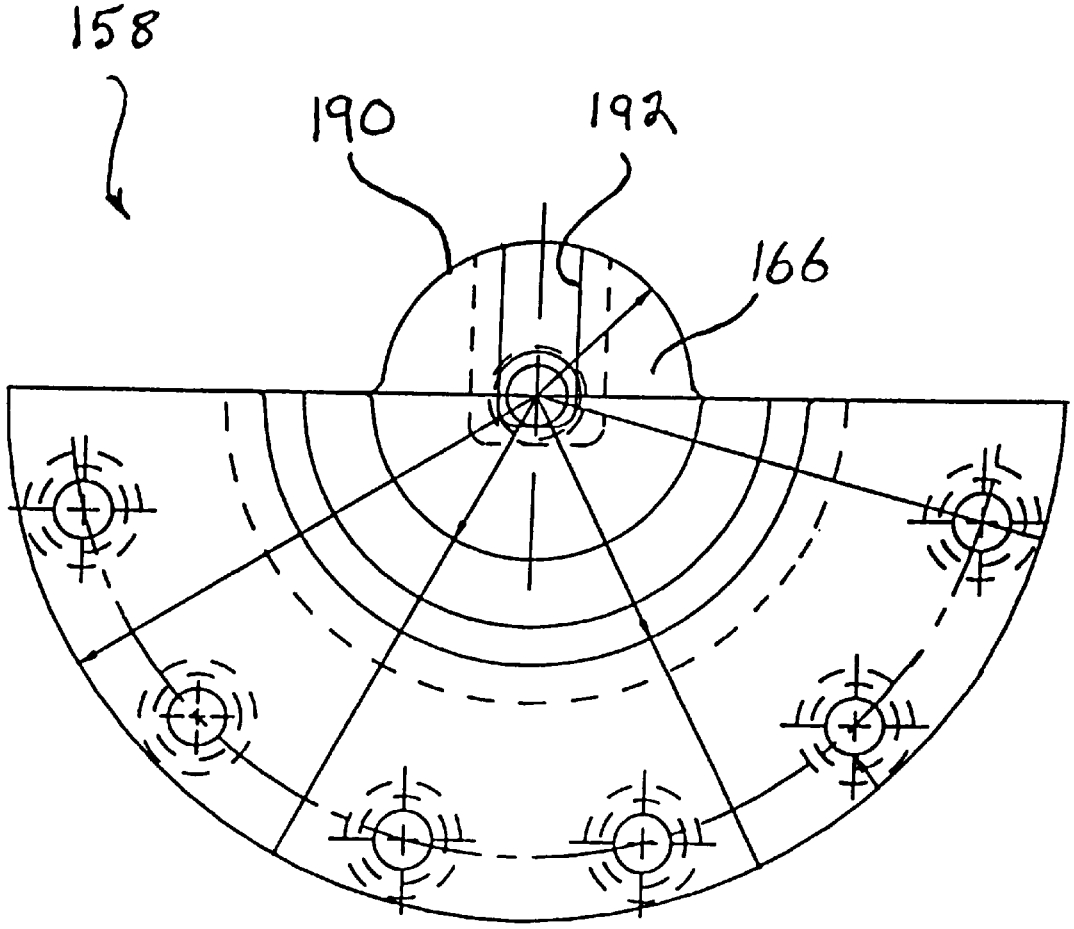
FIG. 34 is an end elevation of the locator block along lines 32—32 in FIG. 33.

A circumferential flange 155 of a field concentrator 156, shown in FIGS. 28 and 29, made highly conductive, high strength material such as beryllium copper, is fastened by screws 157 at one end to the other end of the insulator block 154, as shown in FIG. 23. A locator block 158, also made of ultra-high molecular weight polyethylene, is fastened to the other end of the lower half of the field concentrator 156. The locator block 158 is supported vertically for sliding movement on an upwardly opening semi-cylindrical channel 159 on the top of a cradle block 160 fastened to the facing surface of the main coil assembly 104. The insulator block 154 and field concentrator 156 are split on a horizontal plane through the longitudinal axis of the insulator block 154 and the field concentrator 156 into upper and lower diametrical halves, for ease of insertion of the tube 32 and its nested end fitting 34 into the field concentrator 156 for forming, as described below. A thin layer of electrical insulation 161, such as polyethylene or Teflon or preferably G-10 fiberglass, covers the surface of the upper and lower field concentrator halves along the horizontal plane dividing the upper and lower halves to electrically insulate the two halves of the field concentrator 156 from each other.

Figure 38:
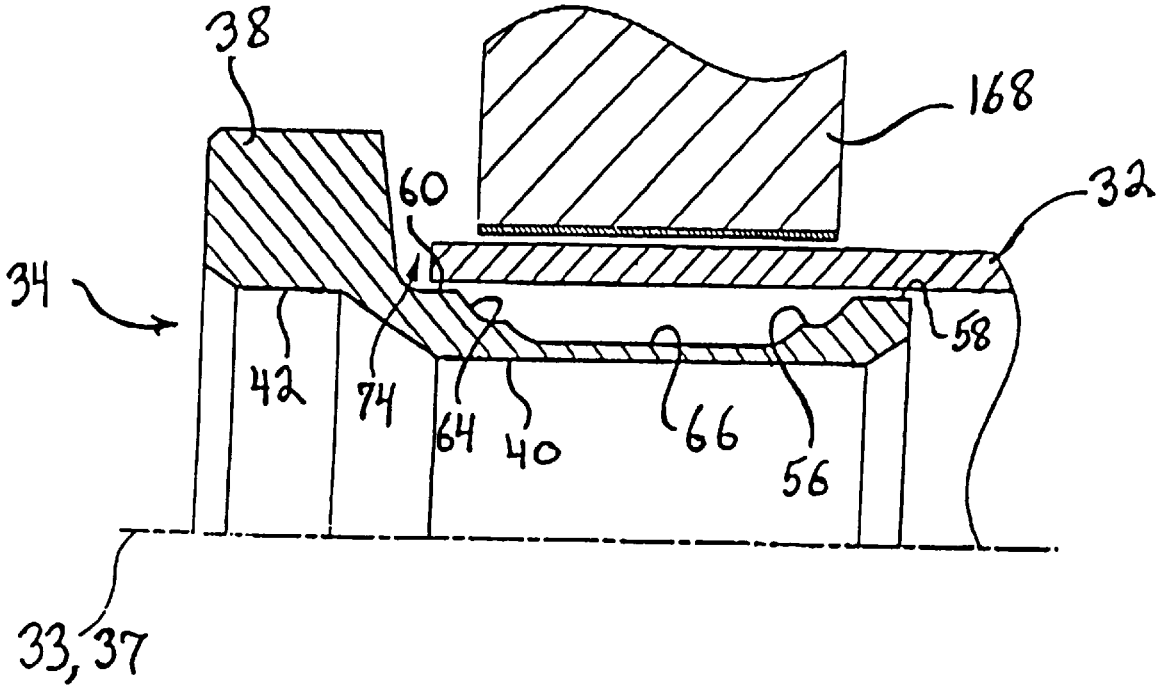
FIG. 38 is an enlarged sectional elevation of one half of the field concentrator web positioned around the tube and end fitting shown in FIG. 23 immediately before forming.

As best shown in FIGS. 30–33, a tube locator 162 in an axial bore 164 in the locator block 158 grips the end fitting 34 and pulls it against a reference surface 166 on the locator block 158, or against a slotted spacer of precisely known thickness inserted between the surface 166 and the end fitting 34, to precisely position the end fitting 34 in the locator block 158, with the central section 57 of the tubular body 36 centered in an insulated channel 167 through the center of a web 168 of the field concentrator 156, as shown in FIG. 38. The position of the tube 32 is set by engagement of the rear end of the tube 32 with the reference surface on the back stop 138 on the rear carriage 114, and then is locked in place by the clamps 134.

The tube locator 162 includes a gripper such as the friction gripper 170 which has an elastomeric element such as a rubber disc 172 compressed between two washers and is sized slightly larger than the counterbore 42 in the end fitting 34. The gripper is pushed into the counterbore 42, slightly compressing the rubber disc 172 by the interference fit, enabling the gripper 170 to exert a frictional force on the end fitting when the gripper is pulled forward, thus pulling the end fitting 34 forward against the shoulder 166 of the locator block 158. The forward pull is exerted by an over-center cam action clamp 173 at the forward end of the tube locator 162. The clamp 173 is commercially available from the De-Sta Company as the Model 602 Toggle Clamp. The clamp 173 is threaded into a counterbored portion 174 of the axial bore 164 in the locator block 158 and has an axial shaft 178 that is moved axially when a handle 180 on the clamp 173 is rotated about its pivot 182. The axial shaft 178 is connected to the gripper 170 by a clevis 184 on the end of a connecting shaft 186. A threaded axial hole 187 through the connecting shaft 186 receives the threaded shank 188 of the gripper 170.

The gripper could also function as a support mandrel in the bore 40 of the end fitting 34. In this modification, the rubber disc 172 is replaced with an elongated cylindrical steel rod long enough to extend the full length of the bore 40 through the tubular body 36 and having a diameter slightly less than the diameter of the bore 40. An O-ring is set in a groove in the steel rod to hold the end fitting in place when the handle 180 of the clamp 173 is shifted to pull the end fitting against the shoulder 166 of the locator block 158. The steel rod supports the floor of the grooves 66 against deformation when the tube 32 is electromagnetically pulse formed onto the tubular body 36.

The axial bore 164 in the locator block lies in a semi-cylindrical hump 190 atop the locator block 158. An upwardly opening slot 192 in the top of the hump 190 communicates with the axial bore 164 and provides clearance for the gripper 170 to rotate about the clevis 184 up and out of the slot 192, so that it is accessible for inserting the end fitting 34 onto the gripper 170.

In operation, an order to manufacture torque tubes 30 of a certain diameter and length is received from the customer and a manufacturing order is sent to the shop. Lengths of tube 32 of the proper diameter and wall thickness are selected and are is cut to the desired length, which is the total length of the torque tube 30 less the thickness of the torque coupling 38 protruding from each end of the torque tube 30 and the width of the gap 74 between the end of the tube 32 and the shoulder 70 on the end fitting step 68. The tube 32 is coated with corrosion protecting primer on its interior surfaces when the tube 32 will not be heat treated at high temperature. The design of the end fitting 32 is tolerant of primer in the interface between the formed tube end and the fitting, so the tube may be primed before forming. That is, the ultimate strength and fatigue resistance of the joint between the tube end and the end fitting is not adversely affected by the presence of primer in the interface. The presence of primer in the joint also contributes to protection from galvanic corrosion should moisture penetrate the sealant applied after forming, as described below.

Figure 20:
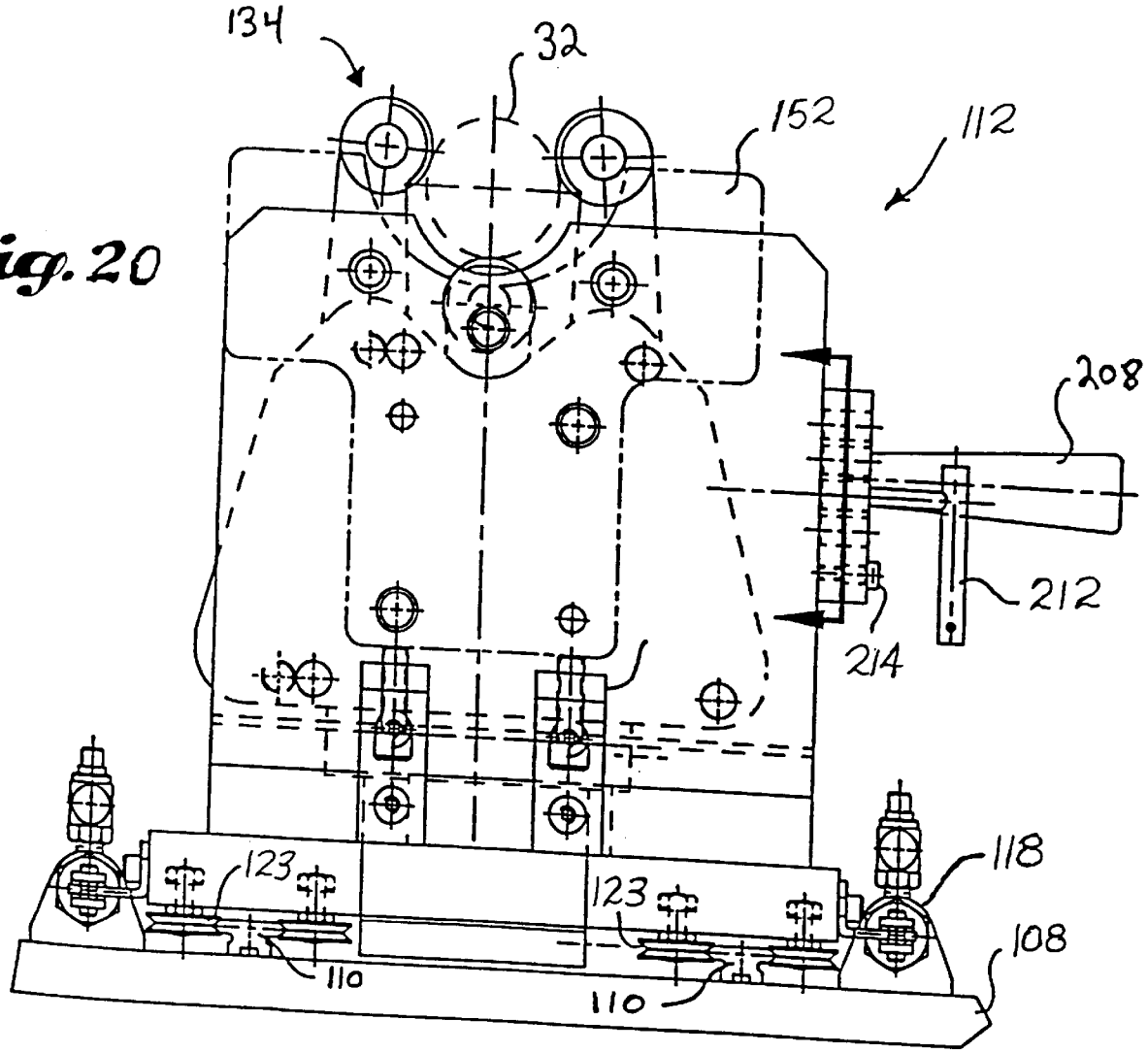
FIG. 20 is an end elevation of the front carriage viewed along lines 20—20 in FIG. 16.

The apparatus 100 is set up by attaching the attachment block 152 of a tube locator assembly 150 of the correct size for that diameter tube 32 to the front face of the front carriage 112, and supporting the locator block 158 of that tube locator assembly on the cradle block 160 in line with the opening 103 in the main coil assembly 104. Attachment of the attachment block 152 to the front carriage assembly is facilitated by a pair of adjustable support brackets 194, shown in FIGS. 15 and 20, attached to the front face of the carriage 112 beneath the position of the attachment block 152.

A calibration bar (not shown) of precisely known length, conveniently about 24 inches, is placed in the tube clamps 134, with its front end against the shoulder 166 of the locator block 158. The cylinders 118 are pressurized by operating the pneumatic control lever shown in FIG. 12 to drive the front carriage forward to the limit of the engagement of the attachment block 152 against the outer face of the cradle block 160. The hand wheel 122 is loosened and the rear carriage 114 is moved forward until front face of the back stop 138 contacts the rear end of the calibration bar. The digital indicator 130 is set for the length of the calibration bar, establishing accurately the distance from the front face of the back stop 138 to the shoulder 166.

Figure 25:
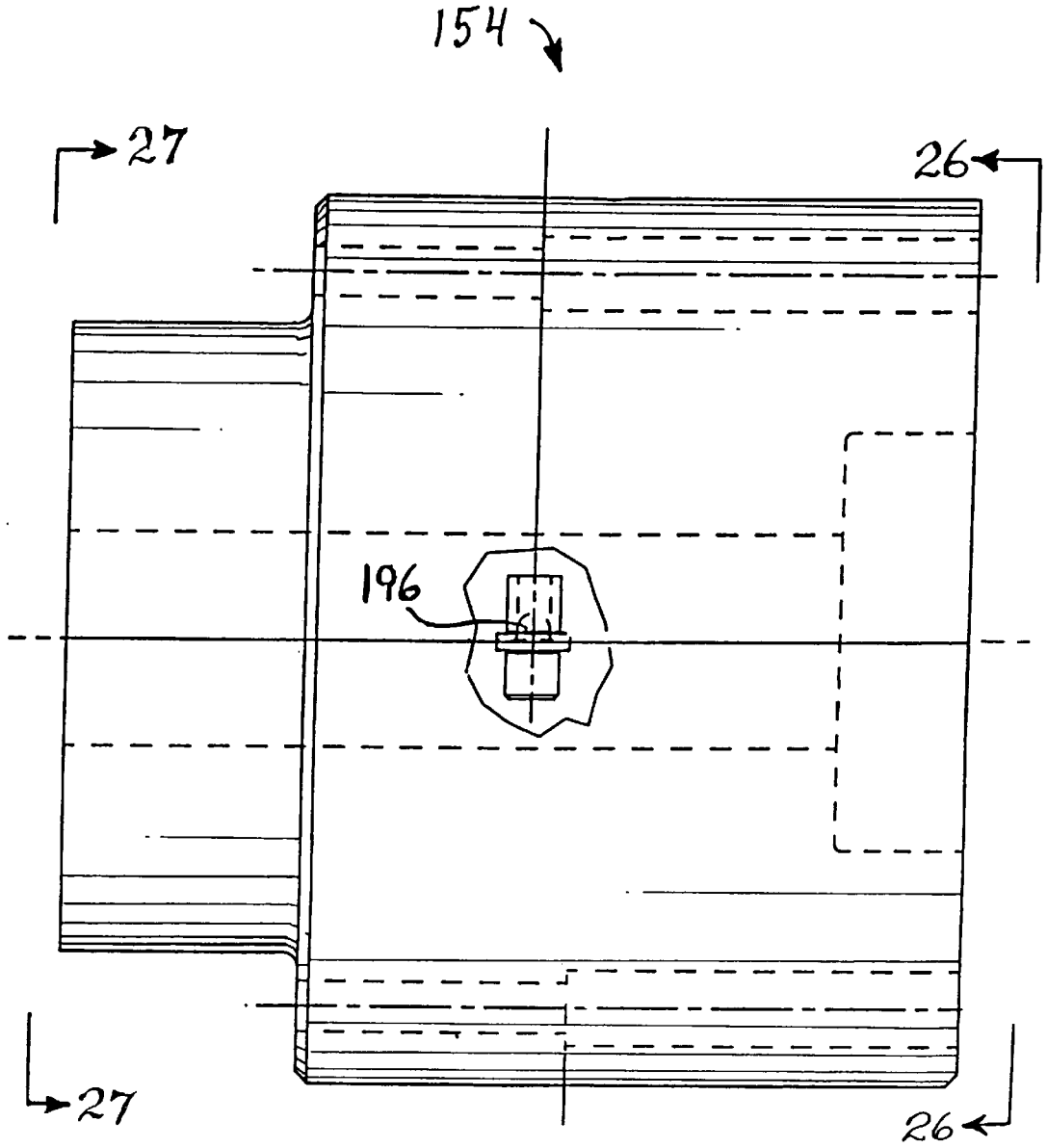
FIG. 25 is an enlarged side elevation of the insulator block shown in FIG. 23.
Figure 26:
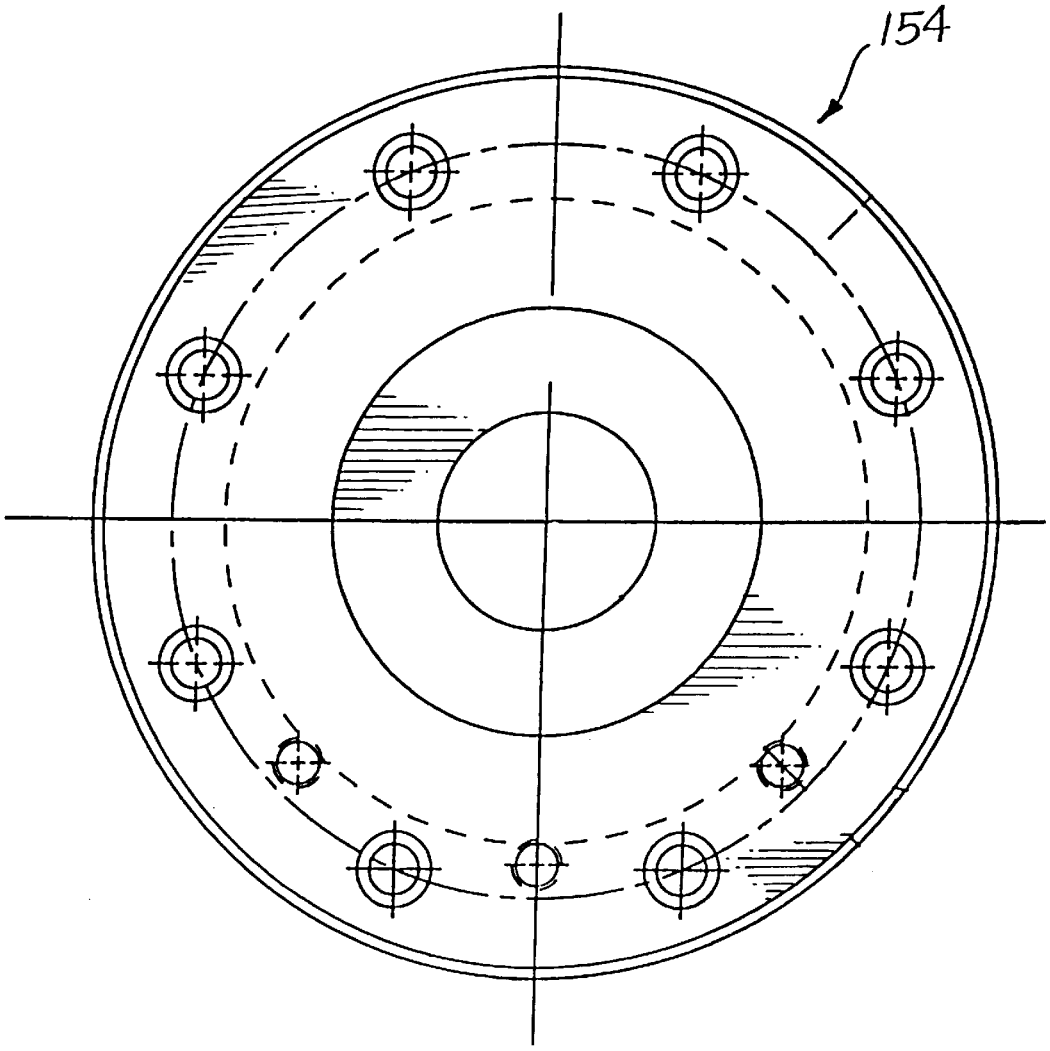
FIG. 26 is an end elevation viewed along lines 26—26 in FIG. 25.
Figure 27:
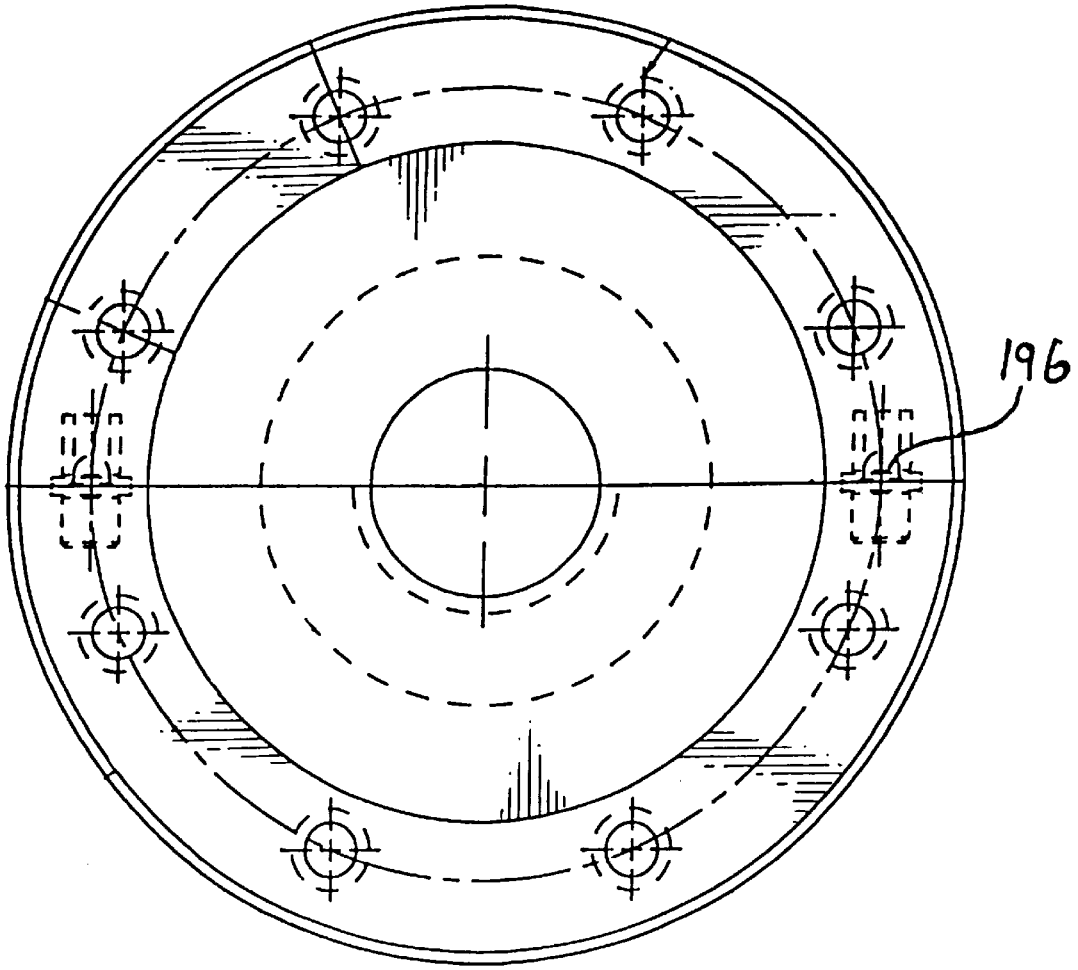
FIG. 27 is an end elevation viewed along lines 27—27 in FIG. 25.

The gripper 170 in the slot 192 in the hump 190 is rotated up and out of the slot, and an end fitting 34 is slipped onto the gripper 170. A tube 32, precut to size, is slipped over the end fitting 34 and laid down onto the tube clamps 134, rotating the gripper back into the slot 192. The tube is slid back in the clamps 134 into contact with the back stop 138 and the control levers in the pneumatic control panel 136 are operated to close the clamps 134. The handle 180 on the toggle clamp 173 is rotated to draw the end fitting against the shoulder 166 in the locator block 158 which accurately centers the center section 57 of the tubular body 36 in the channel 167 through the web 168 of the field concentrator 156. The top half of the horizontally split and axially connected insulator block 154 and field concentrator is place atop the lower half and aligned with the help of alignment buttons 196 set into the top face of the lower half of the insulator block, as shown in FIGS. 23, 25 and 27.

The handle 195 of the pneumatic control valve 125 for the cylinders 118 is rotated to pressurize the cylinders 118 and drive the pistons 116 forward. The pistons 116 push the front carriage 112 forward along the rails 110 to the limit of the travel of the carriage 112, which is when the attachment block 152 contacts the face of the main coil 104. At this position of the front carriage 112, the end of the tube 32 and the end fitting 34 are positioned in the center of the web 168 of the field concentrator 156, and the field concentrator 156 is axially centered in the opening 103 in the coil 104. The tube 32 and fitting are now positioned for electromagnetic forming.

The forming power for the particular tube diameter and wall thickness is selected, from tests previously performed of the optimal power levels for the various tube sizes, and the capacitors in the power supply cabinet 106 are charged. The power can be varied by charging the capacitors to a selected voltage and by charging all or a selected fewer number of capacitors in the capacitor bank. Five sets of capacitors, each with a storage capacity of 12 kilojoules, are provided in the cabinet 106 and may be selected in various combinations and charged to various voltages to give a selection of power levels from which the operator may select. When the capacitors are charged, the operator stands behind a safety shield and depresses a "Start" button on a remote operator panel which remotely operates one or more ignitrons to energize the windings in the coil 104 from the selected number of capacitors in the capacitor bank in the cabinet 106.

A power surge from the capacitors flows through the windings in the coil 104 and produces a rapidly rising magnetic field directed axially through the opening 103 in the main coil 104. The magnetic field induces eddy currents in the field concentrator 156 which flow circumferentially in the flange 155, as indicated by the arrows 198 in FIG. 28. The opening 103 in the main coil 104 is insulated by a suitable layer of insulation such as G-10 fiberglass to prevent eddy currents from shorting between the main coil 104 and the field concentrator 156. The insulation on the surface of the field concentrator at the horizontal dividing line breaks the circumferential conduction path and forces the eddy currents to complete the flow loop by flowing radially into the web 168 and circumferentially around the edges of the channel 167. Since the web narrows in cross-section at its radially inner portions, as shown in FIG. 29, the current density, and hence the magnetic field produced by the current, is intensified through the channel 167 in the web 168 of the field concentrator 156. The eddy currents in the web 168 are insulated from the tube 32 by a layer of insulation lining the channel 167.

The magnetic field in the channel 167 induced by the eddy currents in the web 168 induces an oppositely flowing circumferential eddy current, indicated by the arrows 199, in the tube 32 lying in the channel, as seen in FIGS. 22 and 28. The eddy current around the tube 32 generates a magnetic field opposite to the direction of the magnetic field generated by the eddy currents in the field concentrator, and the opposed magnetic fields result in a powerful radial inward force pulse on the tube, and an equal radial force outward on the field concentrator 156. The force exerted inwardly on the tube deforms the tube walls inward against the tubular body 36 of the end fitting 34. The tubing material is stretched slightly as it conforms to the hexagonal cross-sectional shape of the central section 57 of the tubular body 36 but the rounded points of the hexagonal cross-section and the entry angle of the chamfered surfaces 62 and 64 between the end supporting surfaces 58 and 60 and the flat lands 56, and the surfaces between the flat lands 56 and the grooves 66 is shallow enough that the tubular wall of the tube 32 is not bent or tensioned enough to cause any cracks. However, the grooves 66 permit a radial excursion of the tube material in the central region of the flat lands 56 into the grooves which prevents the tubing material from springing back or rebounding back off the flat lands after the electromagnetic forming impulse force pulse.

As shown in FIG. 38, the web 168 of the field concentrator 156 is centered exactly over the center section 57 of the end fitting tubular body 36, shown in FIGS. 4 and 6. The thickness of the web 168 in the direction of the axis 33 is preferably narrower than the center section 57 of the end fitting tubular body 36 to avoid creation of a high intensity magnetic field that produces a powerful radial force vector on the tube directly over the end supporting surface 58 and a center supporting surface 60 of the end fitting 34. The magnetic field will be strong enough to compress the tube around the supporting surfaces 58 and 60, but it is preferable to limit that force to allow the end of the tube 32 over the supporting surface 60 and the bight portion of the tube over the supporting surface 58 to be drawn in slightly as the tube deforms around and into the center section 57 of the end fitting tubular body 36. The inward drawing of tube material into the center section 57 during forming of the tube onto the end fitting minimizes any stretching of the tube material that otherwise could be caused by pinning the tube 32 to the supporting surfaces 60 and 58 with a radial force of sufficient magnitude to prevent the tube material to be drawn inward over the supporting surfaces 58 and 60 as the tube is formed onto the end fitting 34.

The desirable modulation of the radial force on the tube over the length of the tubular body 36 can also be achieved by chamfering the edges of the web 168 of the field concentrator 156 so the magnetic field intensity is less in the region of the supporting surfaces 58 and 60.

A pulse monitor and recorder system (not illustrated) displays the current delivered to the coil in three forms, the peak pulse current, the pulse width, and the pulse integral. This information for each forming pulse is also recorded and saved for each forming operation and is associated with the identification number for that particular torque tube for statistical process control and for research any problems that may develop with that part.

Figure 12:
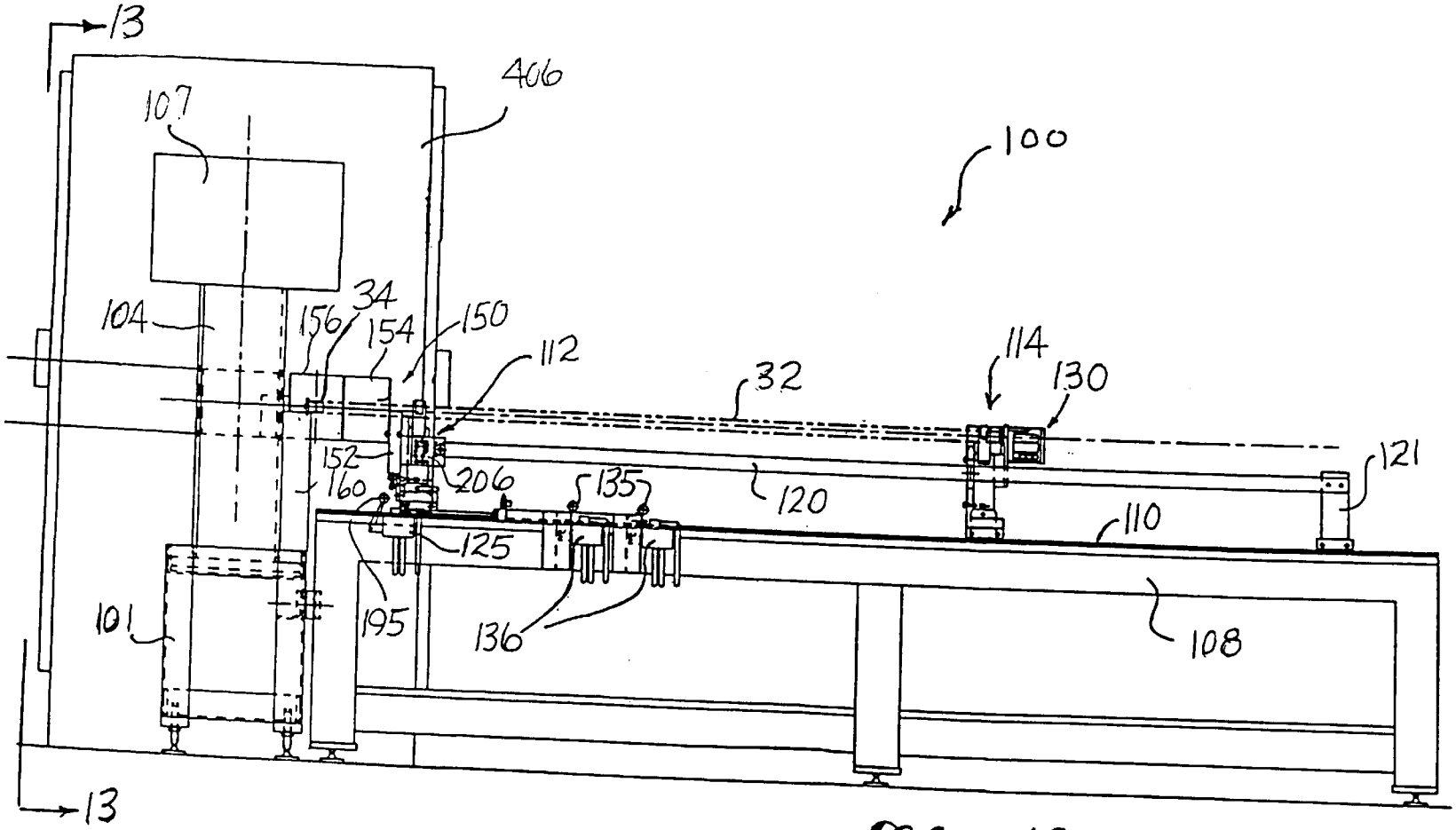
FIG. 12 is an elevation of the forming apparatus shown in FIG. 11, showing overlaid the position of the torque tube and its end fittings in the apparatus.
Figure 13:
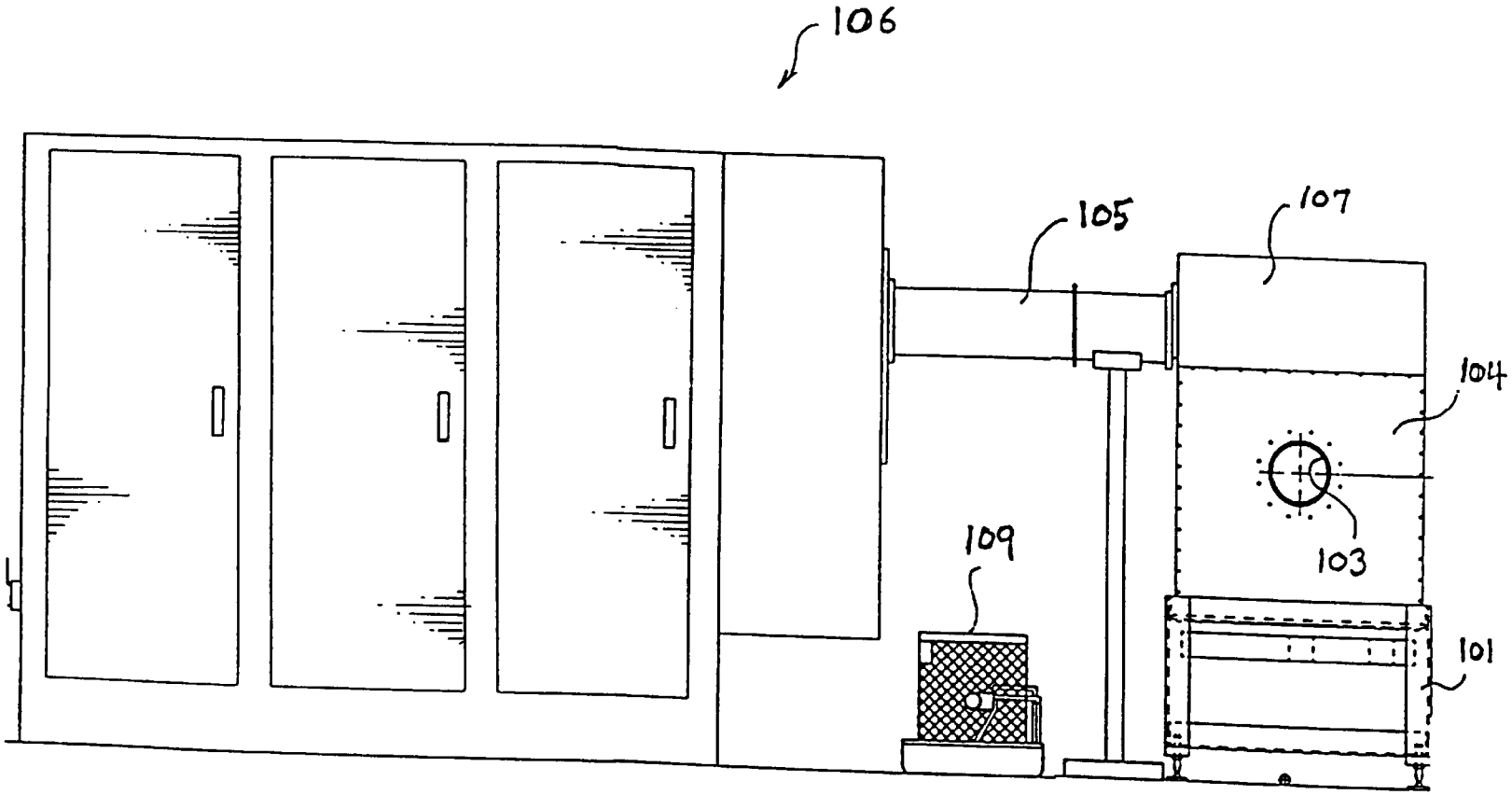
FIG. 13 is an end elevation of the apparatus shown in FIG. 11 along lines 13—13 in FIG. 12.

After forming the tube 32 on the end fitting 34 at one end of the torque tube 30, the lever 195 on the pneumatic control valve 125 is rotated to the right in FIG. 16 to withdraw the piston rods 116 from the extended position shown in FIG. 16 back into the cylinders 118, pulling the front carriage 112 and the connected rear carriage 114 rearward to the limit of the piston rod travel to the retracted position shown in FIG. 12. The connected top halves of the insulator block 154 and field concentrator 158 are lifted off the lower halves and are placed on a platform 210 located conveniently on the table 108 adjacent the main coil 104 at the retracted position of the insulator block and field concentrator. The tube clamps 134 are released by rotating the handles 135 to the right is FIG. 16, and the toggle clamp 173 is released by rotating the handle 180. The tube 32 is lifted out of the tube clamps 134, rotating the gripper 170 and connecting shaft 186 about the pivot for the clevis 184. The formed tube 32 and the end fitting 34 in which it is formed is slid off the gripper 170 and is reversed end-for-end so that the unformed end is now the forward end adjacent the front end of the apparatus 100.

Figure 21:
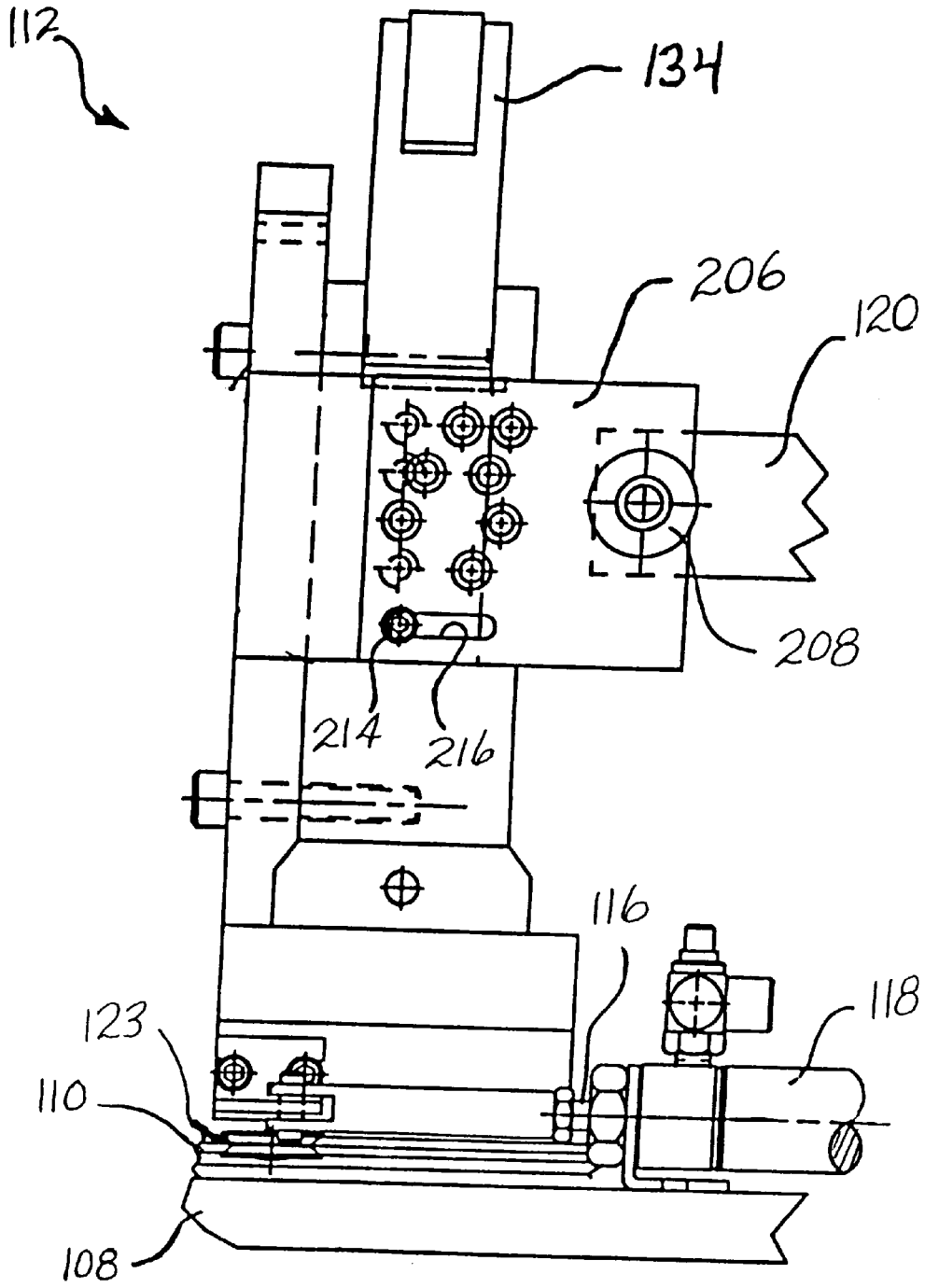
FIG. 21 is a front elevation of the front carriage shown in FIG. 20.

Since the tube 32 and its end fitting 34 attached at one end of the tube 32 are now longer than the tube 32 alone, it is necessary to make an adjustment in the apparatus 100 to accommodate the additional length. This adjustment is provided by an index plate 216 connected to the end of the connecting bar 121 by the threaded end of a handle 218 on the index plate 216 by which the front carriage 112 may be manually moved linearly along the rails 110. The index plate has a series of holes 210 which selectively align with threaded holes in underlying structure on the front carriage 112. A threaded pin 212 with a T-handle, shown most clearly in FIG. 21, secures the index plate 206 in the adjusted position. To make the adjustment, the threaded pin 212 is removed and the index plate 206 is moved a selected incremental distance on the front carriage, increasing the distance between the front carriage 112 and the rear carriage 114 by the thickness of the distal portion 78 of the end fitting 34, plus the width of the gap 74. This increase in the distance between the carriages 112 and 114 positions the other end of the tube 32 at the exact same position on the apparatus 100 as the first end of the tube 32 when the first end was formed onto the first end fitting 34. The threaded index pin 212 is reinserted in the selected hole and screwed in to securely hold the index plate in its new position. A screw 214 in a slot 216 in the index plate 206 is tightened to prevent the index plate 206 from tilting under the influence of an unbalanced moment exerted by vertically separated forces exerted on the index plate 206 by the index pin 212 and the threaded end of the handle 208. The holes 210 in the index plate 206 and the underlying holes in the front carriage 112 are positioned to provide index spacings for all the sizes of end fittings 34 that will be used to make torque tubes 30 on the apparatus 100.

A new end fitting 34 is slid over the gripper 170 and the tube 32 is rotated down onto the tube clamps 134, rotating the gripper 170 and the connecting shaft 186 about the pivot of the clevis 184 into the slot 192. Lengthening the distance between the front and rear carriages by resetting the index plate 206, as described above, accommodates the increased length of the tube 32 with the attached end fitting 34 at the one end, so the one end of the tube 32 with the attached end fitting 34 fits in front of the back stop 138. The handles 135 on the tube clamp control valves 136 are shifted to close the tube clamps 134 and clamp the tube 32 in place. The handle 180 on the toggle clamp 173 is shifted to pull the end fitting 34 in the other end of the tube 32 against the reference surface 166 in the locator block. The tube 32 and the end fitting 34 are now secured in their correct relative positions in the channel of the web 168, as illustrated in FIGS. 22 and 23, ready for forming the tube end onto the fitting. The connected top halves of the field concentrator and insulator block are removed from the platform 200 and placed on top of the lower halves, using the alignment buttons 196 to correctly position the top halves on the bottom halves. The handle 195 on the control valve 125 for the cylinders 118 is shifted to pressurize the cylinders and drive the carriages 112 and 114 forward until the attachment block 152 engages the cradle block 160, at which point the field concentrator 156 is centered with its web 168 in the center of the main coil 104. The coil is energized, as described above, to form the tube end onto the end fitting 34.

The outward magnetically induced force exerted on the field concentrator 156 is resisted inertially by the relatively massive field concentrator halves and is also absorbed by the strong internal structures inside the main coil 104. These internal structures inside the main coil 104 also support the coil itself from radially outward forces exerted on itself when the coil 104 is energized. Thus, the coil and field concentrator structures are designed to be reusable for many years of steady use in an industrial environment. The operation of the apparatus 100 is quiet and safe and permits a high rate of production with predictable repeatable and reproducible results.

The 2024 aluminum tube in the T-3 condition in which it received from the supplier and in which it is formed is susceptible to stress corrosion cracking around the region of the formed end of the tube 32 in presence of salt spray and long duration fatigue loading. Accordingly, the formed torque tube 30 is artificially aged to the T-81 condition at which its susceptibility to stress corrosion cracking is greatly reduced. Artificially aging to the T-81 condition is accomplished by heating the torque tube 30 to 375° F. and holding it at that temperature for 12 hours, then allowing it to cool gradually in air until it reaches room temperature. After cooling, the torque tube in its T-81 condition is painted with a tough, chip resistant paint for corrosion resistance.

When making torque tubes 30 with thin wall tubing at high power settings, the forming rate may be higher than the tubing material can withstand, resulting in small cracks in the region of the shoulder 62. The preferred cure for such cracks is to reduce the power setting so the tube 32 is formed more gently onto the end fitting 34. Alternatively, the tube 32 may be heat treated to the W condition by heating to about 975° F. for 45–60 minutes, and then within 9 seconds it is water quenched, then cooled to about −20° F. until the tube is ready for forming. After forming in the W condition, the tube naturally age hardens to the T-42 condition and is later heat treated to the T-62 condition by heating to about 375° F. for 12 hours and allowed to air cool to room temperature. Like the T-81 condition to which the tube in the T-3 condition is heat treated, the T-62 condition has improved resistance to corrosion stress cracking. When using tubes that are heat treated to the W condition, it is impractical to prime the tubes before forming, so the end fittings are primed instead to produce a layer of primer between the end fitting 34 and the tube 32. The process is tolerant of primer in the interface between the tube and the end fitting and the quality of the joint is not adversely affected by the primer.

The end fittings 34 are sealed in the tube 32 against intrusion of moisture into the interface between the tube 32 and the end fitting 34 to prevent galvanic corrosion that can occur between dissimilar metals in the presence of an electrolyte. Although the interior of the tube 32 was already primer coated prior to forming the end onto the end fitting 34, sealant is applied as double protection. Any sealant that is suitable for the application can be used. For use in the leading edge of an airplane wing, the sealant should be a durable, elastic material that adheres tenaciously and retains its properties for at least about twenty years in the presence of extreme environmental factors of temperature and chemicals in which the torque tube will operate, such as hydraulic fluid and lubricants. The sealant is applied by wiping into the gap 74 and onto the shoulder at the inner axial end 35 of the tubular body 36. Obviously, numerous modifications and variations of the described preferred embodiment will occur to those skilled in the art in light of the teaching herein. Accordingly, it is expressly to be understood that these modifications and variations, and the equivalents thereof, are to be considered within the spirit and scope of the invention as defined in the following claims, wherein:

We claim:

1. A process of forming a metal tube onto an end fitting to establish a rigid, torque transmitting coupling therebetween, comprising:

inserting an end fitting axially into one end of said tube, said end fitting having a tubular main body for torque transmitting connection to said metal tube, and a torque coupling at one end of said tubular main body for coupling to a driven or driving device;

supporting and clamping said tube on a carriage assembly, and positioning and fixing said end fitting at a desired position relative to said tube end;

moving said tube and end fitting in said clamped position on said carriage assembly to locate said tube end and said end fitting in an opening in a stationary coil;

creating a first powerful transient magnetic field axially along said one end of said metal tube and thereby inducing rapidly increasing circumferential eddy currents in said one end of said metal tube;

generating a second rapidly rising transient magnetic field with said eddy currents in said one end of said tube, said second transient magnetic field being opposite in direction from said first transient magnetic field;

generating equal and opposite radial forces on said coil and said one end of said metal tube;

restraining and radially supporting said coil against radial deformation thereof under influence of said radial forces; and forming said one end of said metal tube around and against said end fitting with said radial forces on said tube, conforming said metal tube around said end fitting.

2. A process as defined in claim 1, further comprising:

positioning said tube end and said end fitting in said coil opening with said first magnetic field over a tubular main body of said end fitting with outside and inside axial edges of said magnetic field lying over cylindrical portions of said tubular main body.

3. A process as defined in claim 1, wherein said restraining step includes:

positioning said coil in a strong structural supporting enclosure; and positioning a field concentrator in an opening in said enclosure, insulated therefrom, with a small clearance between said field concentrator and said opening and restraining said field concentrator with circumferential walls of said opening.

4. A process of making a torque tube, comprising:

cutting a metal tube to a desired length for said torque tube;

inserting a tubular body of an end fitting axially into one end of said metal tube, said end fitting having a torque coupling at one end of said tubular body for coupling to a driven or driving device;

forming said metal tube onto said tubular main body of end fitting to establish a rigid, torque transmitting coupling between said end fitting and said metal tube, said forming step including the steps of:

a) creating a first powerful transient magnetic field within a coil around said one end of said metal tube and inducing rapidly increasing eddy currents in said one end of said metal tube;

b) generating a second rapidly rising transient magnetic field with said eddy currents in said one end of said tube, said second transient magnetic field being opposite in direction from said first transient magnetic field;

c) generating equal and opposite radial forces on said coil and said one end of said metal tube by reaction of said first and second magnetic fields; and d) restraining and radially supporting said coil to prevent radial translation thereof under influence of said radial forces;

whereby said one end of said metal tube is formed around and against said tubular main body of said end fitting, conforming said metal tube around said tubular main body to form a torque transmitting rigid joint between tube and said end fitting.

5. A process of making a torque tube as defined in claim 4, wherein said tubular main body has a center section with a cross-sectional shape, on a plane normal to said axis, that is a regular polygon having flat faces between circumferentially spaced corners, and having a groove in said flat faces.

6. A process as defined in claim 5, further comprising:

heat treating said torque tube after said forming step to improve corrosion cracking resistance of said metal tube.

7. A process as defined in claim 5, further comprising:

applying a sealant around said end of said tube and around the other end of said end fitting to seal against ingress of moisture into interface spaces between said tube interior surfaces and said end fitting.

8. A process as defined in claim 5, further comprising:

clamping said tube in tube clamps and clamping said end fitting in a tube locator to precisely position said end fitting in said tube end; and moving said clamped tube and end fitting into an opening within said coil and energizing said coil to generate said first powerful transient magnetic field.

9. A process as defined in claim 8, further comprising:

inducing eddy currents in a field concentrator having a T-shaped cross-section on a plane in which said longitudinal axis lies.

10. An end fitting for connection to the end of a conductive metal tube by electromagnetically forming the tube end around said end fitting, comprising:

a tubular body having a longitudinal axis, and a torque coupling at one axial end of said tubular body;

a center section of said tubular body having a cross section, on a plane normal to said longitudinal axis, that is approximately in the form of a regular polygon having a series of flats circumferentially spaced around said center section;

a groove in each of said flats dimensioned to accommodate a substantial incursion of said tube into said groove when said tube is electromagnetically formed onto said end fitting.

11. An end fitting as defined in claim 10, wherein:

each end of said tubular body has a cylindrical portion having a radius of curvature about equal to a circumscribed circle around said regular polygon.

12. An end fitting as defined in claim 10, wherein:

said groove is longer than 65% of the length of said center section of said tubular body, and is deeper than 15% of the width of said flats.

13. An end fitting as defined in claim 10, wherein:

said tubular body has a wall thickness in a central region of said flats; and said groove has a depth of between 20%–75% of said wall thickness.

14. An end fitting as defined in claim 10, wherein:

said groove is circular in cross section perpendicular to said longitudinal axis.

15. An end fitting as defined in claim 10, further comprising:

a corner circumferentially spaced between each of said flats on said center section of said tubular body, each of said corners forming an angle of greater than 90°.

16. An end fitting as defined in claim 15, wherein:

said circumferentially spaced corners between said flats on said center section of said tubular body are rounded with about the same radius of curvature as said radius of curvature of said circle circumscribed around said regular polygon.

17. An end fitting as defined in claim 10, further comprising:

a step between said inner cylindrical support section and said torque coupling providing a shoulder facing said axial end of said tube and forming a gap therebetween into which a sealant is applied and held for preventing ingress of moisture between said tube and said end fitting.

18. A process of transmitting torque from a driver at one end of a torque tube to a driven device at the other end of said torque tube, comprising:

engaging a torque coupling on an end fitting with said driver for receiving torque from said driver and driving said end fitting;

conveying said torque from said torque coupling to a tubular body of said end fitting, said tubular body having a longitudinal axis and a center section having a cross section perpendicular to said axis that is polygonal in shape, said center section having a plurality of flat faces lying parallel to said axis, said flat faces each having a longitudinal groove therein;

transmitting said torque from said tubular body to a tube formed at one end thereof around said tubular body by electromagnetic pulse forming, said tube tightly conforming around corners at intersections of said flat faces of said tubular body and projecting at least partially into said grooves;

transferring said torque through said tube to an opposite end thereof and to a similar end fitting attached to said opposite end by electromagnetic pulse forming; and engaging a torque coupling on said similar end fitting with said driven device for delivering torque from said torque tube and thereby driving said driven device.

19. A process of transmitting torque as claimed in claim 18, wherein said transmitting step includes:

engaging corners of said tubular body center section, lying at intersections of said flat faces, with said tube formed tightly around said center section.

20. A process of transmitting torque as claimed in claim 18, further comprising:

transmitting axial forces by engagement of shoulders with portions of said tube formed over said shoulders, said shoulders being defined at a junction of opposite ends of said center section and cylindrical supporting sections at both ends of said center section.

21. A process of forming a metal tube onto an end fitting to establish a rigid, torque transmitting coupling therebetween, comprising:

inserting an end fitting axially into one end of said tube, said end fitting having a tubular body for torque transmitting connection to said metal tube, and a torque coupling at one end of said tubular body for coupling to a driven or driving device, said tubular body having a center section with a cross-sectional shape, on a plane normal to said axis, that is a regular polygon having flat faces between circumferentially spaced corners, and having an elongated groove in said flat faces extending parallel to said axis;

creating a first powerful transient magnetic field axially along said one end of said metal tube by current in a field concentrator around said metal tube, and thereby inducing rapidly increasing circumferential eddy currents in said one end of said metal tube;

generating a second rapidly rising transient magnetic field with said eddy currents in said one end of said tube, said second transient magnetic field being opposite in direction from said first transient magnetic field;

generating equal and opposite radial forces on said field concentrator and said one end of said metal tube;

restraining and radially supporting said field concentrator against radial deformation thereof under influence of said radial forces; and forming said one end of said metal tube around and against said end fitting with said radial forces on said tube, conforming said metal tube around said corners of said polygonal shape and partially forming said metal into said grooves to accommodate spring-back of said metal tube and prevent said metal from rebounding away from said faces of said polygonal shape.

22. A process as defined in claim 21, wherein:

said metal tube is made of 2024 aluminum in a T-3 condition during said forming step.

23. A process as defined in claim 21, wherein:

positioning said magnetic field over said tubular body by aligning a web of said field concentrator over said tubular body.

24. A process as defined in claim 21, wherein said creating and restraining steps include:

positioning a coil in a strong structural supporting enclosure;

positioning a field concentrator in an opening in said enclosure with a small clearance between said field concentrator and said opening and restraining said field concentrator inertially and with circumferential walls of said opening; and conducting a surge of electric current to and through said coil.

25. A process for forming a metal tube onto a fitting, comprising:

inserting a fitting into one end of said tube, said fitting having a tubular body on a longitudinal axis and a center section having a cross section perpendicular to said axis that is polygonal in shape, said center section having a plurality of flat faces lying parallel to said axis, said flat faces each having a longitudinal groove therein;

generating a first powerful transient magnetic field in a coil over said tubular body of said fitting with outside and inside axial edges of said magnetic field lying over end portions of said center section of said tubular body at both axial ends of said center section of said end fitting;

forming a portion of said metal tube around and against said fitting with electromagnetic radial forces on said tube, conforming said metal tube around corners of said polygonal shape and partially forming said metal tube into said grooves to accommodate spring-back of said metal tube and prevent said metal tube from rebounding away from said faces of said polygonal shape.

26. A process for forming a metal tube onto an insert as defined in claim 25, further comprising:

clamping said tube in tube clamps and clamping said end fitting in a tube locator to precisely position said end fitting in said tube end; and moving said clamped tube and end fitting into an opening within said coil and energizing said coil to generate said first powerful transient magnetic field.

27. A process for forming a metal tube onto an insert as defined in claim 25, further comprising:

inducing eddy currents in a field concentrator having a T-shaped cross-section on a plane in which said longitudinal axis lies, said field concentrator having a web that is about as thick as said flat faces are long.

28. An apparatus for forming a tube onto an insert in said tube, comprising:

a main coil for creating a first powerful transient magnetic field axially along one end of said tube and thereby inducing rapidly increasing circumferential eddy currents in said one end of said tube, and generating a second rapidly rising transient magnetic field with said eddy currents in said one end of said tube, said second transient magnetic field being opposite in direction from said first transient magnetic field and thereby generating equal and opposite radial forces on said coil and said one end of said metal tube;

structure for restraining and radially supporting said main coil against radial deformation under influence of said radial forces;

a tube clamping and transport system for clamping said tube on a centerline of said main coil and for moving said tube end and said end fitting into said coil for electromagnetic pulse forming said tube end onto said end fitting.

* * * * *